US012808105B2

(12) United States Patent
Dawange et al.

(10) Patent No.: US 12,808,105 B2
(45) Date of Patent: Nov. 24, 2026

(54) REMOVABLE AGITATOR APPARATUS WITH ATTACHABLE AND STOWABLE CLOTHES PICKER

(71) Applicant: WHIRLPOOL CORPORATION, Benton Harbor, MI (US)

(72) Inventors: Jalindar Suresh Dawange, Pune (IN); Ravindra Balkrishna Salunkhe, Pune (IN); Yash Deepak Magdum, Pashan (IN); Shivani Himmatrao Patil, Mumbai (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 93 days.

(21) Appl. No.: 18/943,082

(22) Filed: Nov. 11, 2024

(65) Prior Publication Data

US 2026/0132560 A1 May 14, 2026

(51) Int. Cl.

| | |
|---|---|
| ***D06F 17/10*** | (2006.01) |
| ***D06F 7/00*** | (2006.01) |
| ***D06F 13/02*** | (2006.01) |
| ***D06F 29/00*** | (2006.01) |

(52) U.S. Cl.
CPC ..... *D06F 7/00* (2013.01); *D06F 13/02* (2013.01); *D06F 17/10* (2013.01); *D06F 29/00* (2013.01)

(58) Field of Classification Search
CPC ..... D06F 13/02; D06F 17/10
See application file for complete search history.

(56) References Cited

U.S. PATENT DOCUMENTS

| | | | |
|---|---|---|---|
| 11,453,969 | B1 | 9/2022 | Ford |
| 2012/0060878 | A1 | 3/2012 | Thiessens |

FOREIGN PATENT DOCUMENTS

| | | | |
|---|---|---|---|
| KR | 200442803 | Y1 | 12/2008 |
| WO | 2012113050 | A2 | 8/2012 |

*Primary Examiner* — Spencer E. Bell
(74) *Attorney, Agent, or Firm* — BROOKS KUSHMAN P.C.

(57) ABSTRACT

A removable clothes mover of a laundry treatment machine for retrieving laundry items is provided. The mover includes a barrel having upper and lower ends, a hook having a generally J-shaped structure for grabbing and holding laundry items and a handle portion attached to the upper end of the barrel, the handle portion defining a cavity sized for receiving the hook in an orientation where a free end of the hook points downward and a shank portion of the hook is aligned parallel to a side of the handle, wherein the hook is selectively attachable to the removable clothes mover in each of a stowed configuration wherein the hook is nested into the cavity of the handle portion, or a grabbing configuration wherein the hook is attached to a lower end of the barrel for use in retrieving the laundry items.

14 Claims, 17 Drawing Sheets

REMOVABLE AGITATOR APPARATUS WITH ATTACHABLE AND STOWABLE CLOTHES PICKER

FIELD OF DISCLOSURE

Aspects of the disclosure generally relate to removable agitators for laundry treating appliances, and in particular to removable agitators having a configurable clothes picker attachment.

BACKGROUND

Laundry treating appliances, such as clothes washers, clothes dryers, washing machines, refreshers, and non-aqueous systems, can have a configuration based on a container, such as a laundry basket or drum that defines a drum opening, which may or may not rotate, and that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, or detergents, can be supplied to the treating chamber in accordance with the cycle of operation.

Laundry treating appliances typically operate to treat laundry items by placing the laundry items in contact with treating fluid such as a detergent/water mixture, sometimes referred to as wash liquor, and providing relative motion between the laundry items and the fluid. The controller can further control a motor to rotate the laundry basket or drum according to one of the pre-programmed cycles of operation. The controller can also control a clothes mover provided within the laundry basket or drum and configured to impart mechanical energy to laundry items within the treating chamber according to a selected cycle of operation. The clothes mover can include multiple components, such as a base, which can be provided as an impeller plate, and a barrel, which can be provided as an agitator post, and which can couple to the base.

There may be occasions where laundry items are difficult to reach. For example, for a top-loading machine there may be laundry items present at the bottom of the laundry basket that are difficult to retrieve. This may be especially so for shorter individuals. In such a situation, it may be difficult to remove the laundry items from the laundry treating machine.

SUMMARY

In one or more illustrative examples, a removable clothes mover of a laundry treatment machine for retrieving laundry items includes a barrel having upper and lower ends; a hook having a curved portion for grabbing and holding laundry items; and a handle portion attached to the upper end of the barrel, the handle portion defining a cavity sized for receiving the hook in an orientation where a free end of the hook points downward and a shank portion of the hook is aligned parallel to a side of the handle portion, wherein the hook is selectively positionable to each of: a stowed configuration wherein the hook is nested into the cavity of the handle portion, or a grabbing configuration wherein the hook is extended relative to a lower end of the barrel for use in retrieving the laundry items.

In one or more illustrative examples, the cavity of the handle portion defines a recess that is complementary in shape to the hook, such that in the stowed configuration, the hook is substantially flush with the exterior surface of the handle portion.

In one or more illustrative examples, a first portion of the cavity is defined into a first side of the handle portion to receive the shank portion of the hook, and a second portion of the cavity is defined into the top and/or other side of the handle portion to receive a curved portion of the hook.

In one or more illustrative examples, in the grabbing configuration, the hook is oriented such that the free end points upwards and the shank portion spaces the curved portion below the lower end of the barrel.

In one or more illustrative examples, the hook comprises a latch mechanism configured to selectively lock the hook into the handle portion in the stowed configuration and lock the hook into the barrel in the grabbing configuration.

In one or more illustrative examples, the barrel defines a barrel attachment aperture as a through hole into the interior of the barrel, the handle portion defines a handle attachment aperture as a through hole into the interior of the handle portion, and the latch mechanism comprises a slide movable laterally through the shank portion, the slide being sized to be insertable into each of the barrel attachment aperture and the handle attachment aperture.

In one or more illustrative examples, the barrel comprises a standoff located inside the barrel, the handle portion comprises a standoff located inside the handle portion, and the slide defines one or more attachment members extending transversely from the slide, the one or more attachment members each comprising a wedge having a flat face spaced apart from the slide and an angled face sloped toward the free end of the respective attachment member, wherein the flat face of the wedge is located to secure the hook in the grabbing configuration by engaging a respective standoff, and the angled face is configured to facilitate disengagement by urging the respective attachment member out of the aperture by riding the respective standoff.

In one or more illustrative examples, the slide comprises a button that, when pressed, causes the slide to move laterally inward into the attachment apertures to disengage the wedge of the one or more attachment members from one of the standoffs, allowing the hook to be removed from the grabbing configuration or the stowed configuration.

In one or more illustrative examples, the mover further comprises a spring to bias the button laterally outward with respect to the attachment apertures, such that the slide automatically returns to a locked position when the button is released.

In one or more illustrative examples, the exterior surface of the barrel comprises one or more radially extending vanes to impart mechanical action to laundry items during operation of the laundry treatment machine.

In one or more illustrative examples, the hook further comprises a rib extending from a throat side of the shank portion to the curved portion of the hook to provide additional rigidity to the hook.

In one or more illustrative examples, a removable clothes mover of a laundry treatment machine for retrieving laundry items includes a barrel having upper and lower ends, the barrel defining a barrel attachment aperture towards the lower end; a hook having a generally J-shaped structure for grabbing and holding laundry items; and a handle portion attached to the upper end of the barrel, the handle portion defining a cavity sized for receiving the hook in an orientation where a free end of the hook points downward and a shank portion of the hook is aligned parallel to a side of the handle portion, the cavity defining a handle attachment aperture; a latch mechanism including a slide movable laterally through the shank portion of the hook, the slide being sized to be insertable into each of the barrel attachment aperture and the handle attachment aperture; wherein the hook is selectively positionable in each of a stowed configuration wherein the hook is nested into the cavity of the handle portion and the slide engages into the handle attachment aperture, or a grabbing configuration for use in retrieving the laundry items wherein the hook is extended relative to a lower end of the barrel such that the slide engages into the handle attachment aperture.

In one or more illustrative examples, the barrel comprises a standoff located inside the barrel, the handle portion comprises a standoff located inside the handle portion, and the slide defines one or more attachment members extending transversely from the slide, the one or more attachment members each comprising a wedge having a flat face spaced apart from the slide and an angled face sloped toward the free end of the respective attachment member, wherein the flat face of the wedge is located to secure the hook in the grabbing configuration by engaging a respective standoff, and the angled face is configured to facilitate disengagement by urging the respective attachment member out of the aperture by riding the respective standoff.

In one or more illustrative examples, the slide comprises a button that, when pressed, causes the slide to move laterally inward into the attachment apertures to disengage the wedge of the one or more attachment members from one of the standoffs, allowing the hook to be removed from the grabbing configuration or the stowed configuration; and a spring to bias the button laterally outward with respect to the attachment apertures, such that the slide automatically returns to a locked position when the button is released.

In one or more illustrative examples, a method for transitioning a removable clothes mover of a laundry treatment machine between a stowed configuration and a grabbing configuration, the removable clothes mover comprising a hook, a barrel, and a handle portion includes pressing a button attached to a slide mechanism of the hook to disengage a wedge of a handle attachment member from a handle standoff located inside the handle portion; sliding the hook upward and out of a cavity in the handle portion to remove the hook from the stowed configuration; aligning the hook with an attachment aperture located at a lower end of the barrel; inserting a slide of the hook into the attachment aperture of the barrel; and releasing the button to engage a wedge of a barrel attachment member with a barrel standoff inside the barrel, thereby securing the hook in the grabbing configuration.

In one or more illustrative examples, the method further includes pressing the button to disengage the wedge of the barrel attachment member from the barrel standoff inside the barrel; sliding the hook upward and out of the attachment aperture of the barrel to remove the hook from the grabbing configuration; aligning the hook with the cavity of the handle portion; inserting the slide of the hook into the attachment aperture of the handle portion; and releasing the button to engage the wedge of the handle attachment member with the handle standoff inside the handle portion, thereby securing the hook in the stowed configuration.

In one or more illustrative examples, transitioning the hook from the stowed configuration to the grabbing configuration further includes positioning the hook such that a free end of the hook points upward and a shank portion of the hook extends below the lower end of the barrel.

In one or more illustrative examples, transitioning the hook from the grabbing configuration to the stowed configuration further includes positioning the hook such that a free end of the hook points downward and a shank portion of the hook aligns parallel to a side of the handle portion, with the hook being substantially flush with an exterior surface of the handle portion.

In one or more illustrative examples, engaging the wedge of the barrel attachment member with the barrel standoff inside the barrel prevents movement of the hook within the attachment aperture during use in the grabbing configuration.

In one or more illustrative examples, engaging the wedge of the handle attachment member with the handle standoff inside the handle portion prevents movement of the hook within the cavity during storage in the stowed configuration.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Some users may have difficulty retrieving clothes or other items from the drum of vertical axis laundry machines. Aspects of the disclosure address this by providing a removable clothes mover that features a J-shaped hook for grabbing and holding laundry items. The clothes mover comprises a handle portion, a barrel, and a hook that can be selectively configured in either a stowed position, where the hook is nested flush within the handle for compact storage, or a grabbing configuration, where the hook is attached to the lower end of the barrel for use in retrieving clothes. A latch mechanism with a slide allows the hook to be securely locked into place in both configurations using attachment apertures in the handle and barrel. The removable agitator may also be attached to impart mechanical action to laundry items during operation, enhancing the cleaning process. This configurable approach simplifies the task of removing items from the drum while maintaining a compact and versatile design.

Figure 1:
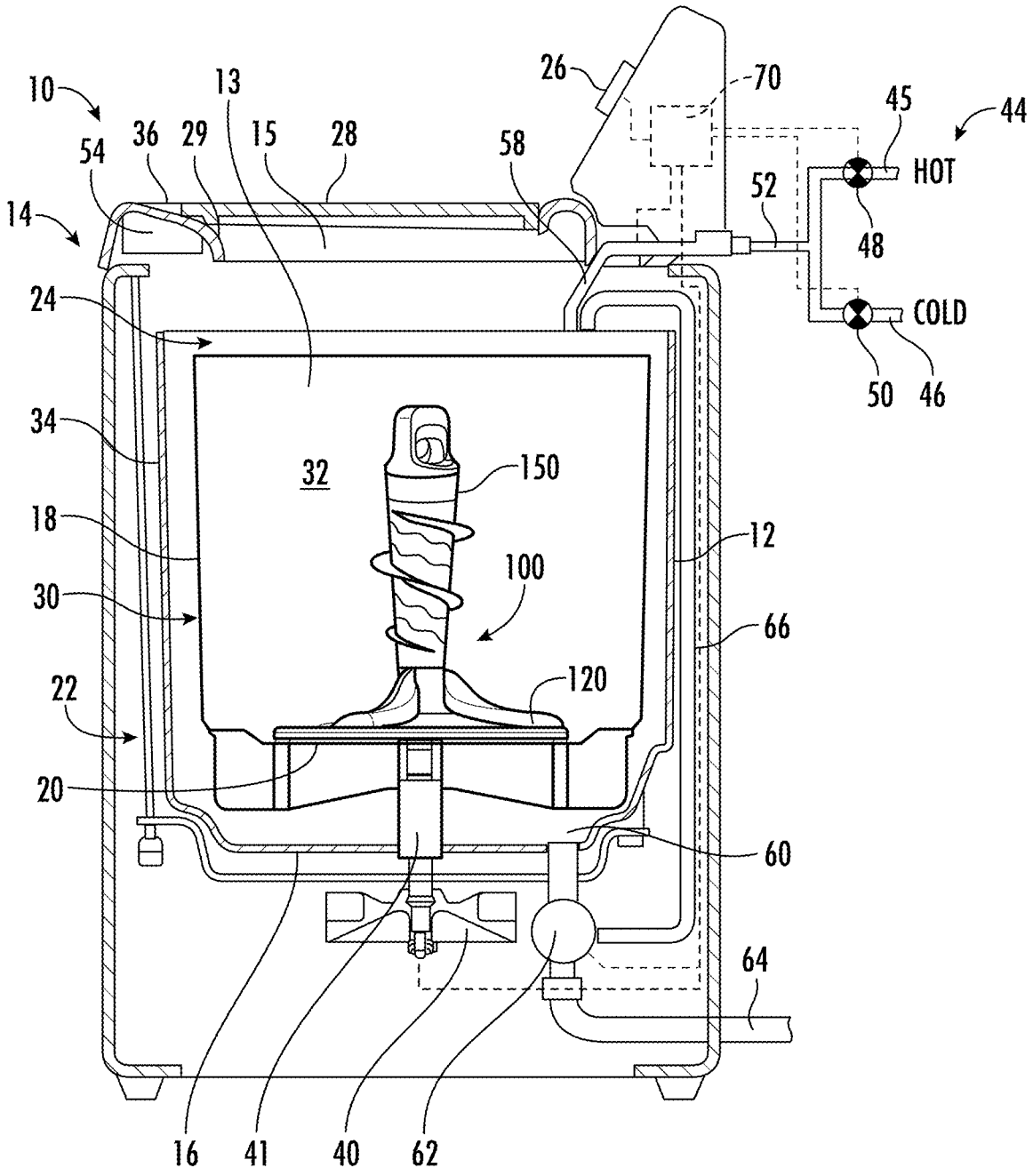
FIG. 1 illustrates a simplified cross-sectional view of a laundry treating appliance including a removable agitator.

FIG. 1 is a simplified view of a laundry treating appliance 10 including a removable agitator 150. The removable agitator 150 may include an attachable clothes retriever as shown in detail in FIGS. 1-15J. The laundry treating appliance 10 can be any laundry treating appliance 10 that performs a cycle of operation to clean or otherwise treat laundry items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 is illustrated herein as a vertical axis, top-load laundry treating appliance 10, the aspects of the present disclosure can have applicability in laundry treating appliances 10 with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances 10 are typically categorized as either a vertical axis laundry treating appliance 10 or a horizontal axis laundry treating appliance 10. As used herein, the term "horizontal axis" laundry treating appliance 10 refers to a laundry treating appliance 10 having a rotatable drum that rotates about a generally horizontal axis relative to a surface that supports the laundry treating appliance 10. The drum can rotate about the axis inclined relative to the horizontal axis, with fifteen degrees of inclination being one example of the inclination. Similar to the horizontal axis laundry treating appliance 10, the term "vertical axis" laundry treating appliance 10 refers to a laundry treating appliance 10 having a rotatable drum that rotates about a generally vertical axis relative to a surface that supports the laundry treating appliance 10. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance 10 refers to a laundry treating appliance 10 having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances 10, the drum rotates about a vertical axis generally perpendicular to a surface that supports the laundry treating appliance 10. However, the rotational axis need not be vertical. The drum can rotate about an axis inclined relative to the vertical axis.

As used herein, the "horizontal axis" laundry treating appliance 10 refers to a laundry treating appliance 10 having a rotatable drum, perforated or imperforate, that holds laundry items and washes and/or dries the laundry items. In some horizontal axis laundry treating appliances 10, the drum rotates about a horizontal axis generally parallel to a surface that supports the laundry treating appliance 10. However, the rotational axis need not be horizontal. The drum can rotate about an axis inclined or declined relative to the horizontal axis. In horizontal axis laundry treating appliances 10, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance 10 can be top-loading or front-loading. In a top-loading laundry treating appliance 10, laundry items are placed into the drum through an access opening in the top of a cabinet, while in a front-loading laundry treating appliance 10 laundry items are placed into the drum through an access opening in the front of a cabinet. If a laundry treating appliance 10 is a top-loading horizontal axis laundry treating appliance 10 or a front-loading vertical axis laundry treating appliance 10, an additional access opening is located on the drum.

In more detail, the laundry treating appliance 10 can include a structural support assembly comprising a cabinet 14, which defines a housing and an interior, within which a laundry holding assembly resides. The cabinet 14 can be a housing having a chassis and/or a frame, to which decorative panels can or cannot be mounted, defining an interior, enclosing components typically found in a conventional laundry treating appliance 10, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated exemplary laundry treating appliance 10 can include a rotatable basket 30 having an open top 13 that can be disposed within the interior of the cabinet 14 and can at least partially define a rotatable treating chamber 32 for receiving laundry items for treatment and an access opening 15. The access opening 15 can provide access to the treating chamber 32. The treating chamber 32 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, a jacket, bedding, blankets, rugs, pillows, etc.

The open top 13 can be aligned with the access opening 15. A tub 34 can also be positioned within the cabinet 14 and can define an interior 24 within which the basket 30 can be positioned. The tub 34 can also at least partially define at least a portion of the treating chamber 32. The tub 34 can have a generally cylindrical side or tub peripheral wall 12 closed at its bottom end by a base 16 that can at least partially define a sump 60. The tub 34 can be at least partially aligned with the access opening 15 and the open top 13. In one example, the tub 34, the basket 30, along with the open top 13, and the access opening 15, can have central axes that are co-axial with one another, or with at least one of the other axes, such that a common central axis is formed.

The basket 30 can have a generally peripheral side wall 18, which is illustrated as a cylindrical side wall, closed at the basket end by a basket base 20 to further at least partially define the treating chamber 32. The basket 30 can be rotatably mounted within the tub 34 for rotation about a vertical basket axis of rotation and can include a plurality of perforations (not shown), such that liquid can flow between the tub 34 and the rotatable basket 30 through the perforations (not shown). While the illustrated laundry treating appliance 10 includes both the tub 34 and the basket 30, with the basket 30 at least partially defining the treating chamber 32, it is also within the scope of the present disclosure for the laundry holding assembly to include only one receptacle, such as the tub 34, without the basket 30, with the receptacle defining the laundry treating chamber 32 for receiving the load to be treated.

The cabinet 14 can further define a top wall or top panel 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34.

A selectively openable closure or cover, illustrated herein as comprising a lid 28, can be movably mounted to or coupled to the cabinet 14 for selective movement between an opened position and a closed position, as shown, to selectively open and close the access opening 15, respectively, and to selectively provide access into the laundry treating chamber 32 through the access opening 15 of the basket 30. In one example, the lid 28 can be rotatable between the closed position and the opened position relative to the cabinet 14. By way of non-limiting example, the lid 28 can be hingedly coupled to the cabinet 14 for movement between the opened position and the closed position. In the closed position, the lid 28 can seal against at least one of the access opening 15, the top panel 36, or the shroud 29 and can at least partially confront the treating chamber 32 when the lid 28 closes the access opening 15. In the opened position, the lid 28 can be spaced apart from the access opening 15, the top panel 36, or the shroud 29 and can allow access to the top panel 36 and the access opening 15.

A clothes mover 100 can be rotatably mounted within the basket 30 to impart mechanical agitation and energy to a load of laundry items placed in the basket 30 or the treating chamber 32 according to a cycle of operation. The clothes mover 100 can be oscillated or rotated about its vertical axis of rotation during a cycle of operation in order to produce load motion effective to wash the load contained within the treating chamber 32. The clothes mover 100 can comprise a base or a first clothes mover, illustrated herein as an impeller 120, and a barrel, illustrated herein as an agitator 150. The agitator 150 as illustrated herein can comprise a vertically oriented agitator post that can be removably coupled with the impeller 120, the agitator 150 projecting vertically from the impeller 120 within the treating chamber 32 and toward the open top 13 of the basket 30. In this aspect of the disclosure, the clothes mover 100 can be formed by coupling an additional component, the agitator 150, to the impeller 120 and can be thought of as forming a second clothes mover.

The agitator 150 can include any configuration of vanes, blades, or other structural features for imparting mechanical energy to laundry items during a cycle of operation. Generally, the vertical extent of the agitator 150, combined with vane, blade, or other structural features, can impart the mechanical action to laundry items, which provides improved cleaning performance and can be suitable for particularly soiled loads. Other exemplary types of clothes movers include, but are not limited to, an agitator alone, a wobble plate, and a hybrid impeller/agitator.

The basket 30 and the clothes mover 100 can be driven, such as to rotate within the tub 34, by a drive assembly 40 that includes a motor 41, which can include a gear case, operably coupled with the basket 30 and clothes mover 100. The motor 41 can be a brushless permanent magnet (BPM) motor having a stator (not shown) and a rotor (not shown). Alternately, the motor 41 can be coupled to the basket 30 through a belt and a drive shaft to rotate the basket 30, as is known in the art. Other motors, such as an induction motor or a permanent split capacitor (PSC) motor, can also be used. The motor 41 can rotate the basket 30 at various speeds in either rotational direction about the vertical axis of rotation during a cycle of operation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 40 and can selectively operably couple the motor 41 with either the basket 30 and/or the clothes mover 100.

A suspension assembly 22 can dynamically hold the tub 34 within the cabinet 14. The suspension assembly 22 can dissipate a determined degree of vibratory energy generated by the rotation of the basket 30 and/or the clothes mover 100 during a treating cycle of operation. Together, the tub 34, the basket 30, and any contents of the basket 30, such as liquid and laundry items, define a suspended mass for the suspension assembly 22.

The laundry treating appliance 10 can further include a liquid supply assembly to provide liquid, such as water or a combination of water and one or more wash aids, such as detergent, into the treating chamber 32 for use in treating laundry items during a cycle of operation. The liquid supply assembly can include a water supply 44 configured to supply hot or cold water. The water supply 44 can include a hot water inlet 45 and a cold water inlet 46. A valve assembly can include a hot water valve 48, a cold water valve 50, and various conduits 52, 58 for selectively distributing the water supply 44 from the hot water and cold water inlets 45, 46. The valves 48, 50 are selectively openable to provide water from a source of water, such as from a household water supply (not shown) to the conduit 52. A second water conduit, illustrated as the water inlet 58, can also be fluidly coupled with the conduit 52 such that water can be supplied directly to the treating chamber 32 through the open top 13 of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e., a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30 for use in treating the laundry items according to a cycle of operation, either directly or mixed with water from the water supply 44. The treating chemistry dispenser 54 can be a single use dispenser, a bulk dispenser, or a combination of or an integrated single use and bulk dispenser, in non-limiting examples, and is fluidly coupled to the treating chamber 32. While the treating chemistry dispenser 54 is illustrated herein as being provided at the top panel 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e., a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply assembly and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation and drain assembly can be provided with the laundry treating appliance 10 for recirculating liquid from within the laundry holding assembly and draining liquid from the laundry treating appliance 10. Liquid supplied to the tub 34 or into the treating chamber 32 through the water inlet 58 and/or the treating chemistry dispenser 54 typically enters a space between the tub 34 and the basket 30 and can flow by gravity to the sump 60. More specifically, the sump 60 can be located in and formed in part by the bottom of the tub 34 and the liquid recirculation assembly can be configured to recirculate treating liquid from the sump 60 onto the top of a laundry load located in the treating chamber 32.

A pump 62 can be housed below the tub 34 and can have an inlet fluidly coupled with the sump 60 and an outlet configured to fluidly couple and to direct liquid to either or both a household drain 64, which can drain the liquid from the laundry treating appliance 10, or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid from the recirculation conduit 66 into the open top 13 of the basket 30. The recirculation conduit 66 can introduce the liquid into the basket 30 in any suitable manner, such as by spraying, dripping, or providing a steady flow of liquid. In this manner, liquid provided to the tub 34, with or without treating chemistry can be recirculated into the treating chamber 32 for treating the laundry within. The liquid recirculation and drain assembly can include other types of recirculation assemblies.

It is noted that the illustrated drive assembly, suspension assembly, liquid supply assembly, recirculation and drain assembly, and dispensing assembly are shown for exemplary purposes only and are not limited to the assemblies shown in the drawings and described above. For example, the liquid supply and recirculation and pump assemblies can differ from the configuration shown in FIG. 1, such as by inclusion of other valves, conduits, sensors (such as liquid level sensors and temperature sensors), and the like, to control the flow of liquid through the laundry treating appliance 10 and for the introduction of more than one type of treating chemistry. For example, the liquid supply assembly can be configured to supply liquid into the interior of the basket 30 or into the interior of the tub 34 not occupied by the basket 30, such that liquid can be supplied directly to the tub 34 without having to travel through the basket 30. In another example, the liquid supply assembly can include a single valve for controlling the flow of water from the household water source. In another example, the recirculation and pump assembly can include two separate pumps for recirculation and draining, instead of the single pump 62 as previously described.

The laundry treating appliance 10, and specifically the liquid supply and/or recirculation and drain assemblies, can be provided with a heating assembly (not shown), which can include one or more devices for heating laundry and/or to heat liquid provided to the treating chamber 32 as part of a cycle of operation, such as, for example, a steam generator, which can be any suitable type of steam generator, such as a flow through steam generator or a tank-type steam generator, and/or a sump heater. Alternatively, the sump heater can be used to generate steam in place of or in addition to the steam generator. In one example, the heating assembly can include a heating element provided in the sump 60 to heat liquid that collects in the sump 60. Alternatively, the heating assembly can include an in-line heater that heats the liquid as it flows through the liquid supply, dispensing and/or recirculation assemblies.

The laundry treating appliance 10 can further include a control assembly, illustrated herein as a controller 70, for controlling the operation of the laundry treating appliance 10 and coupled with various working components of the laundry treating appliance 10 to control the operation of the working components and to implement one or more treating cycles of operation. The control assembly can include the controller 70 located within the cabinet 14 and a user interface 26 that can be operably coupled with the controller 70. The user interface 26 can provide an input and output function for the controller 70.

The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 70 to communicate with the user in a variety of ways. For example, the controller 70 can be configured to send a text message to the user, send an electronic mail to the user, or provide audio information to the user either through the laundry treating appliance 10 or utilizing another device such as a mobile phone.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the laundry treating appliance 10.

Figure 2:
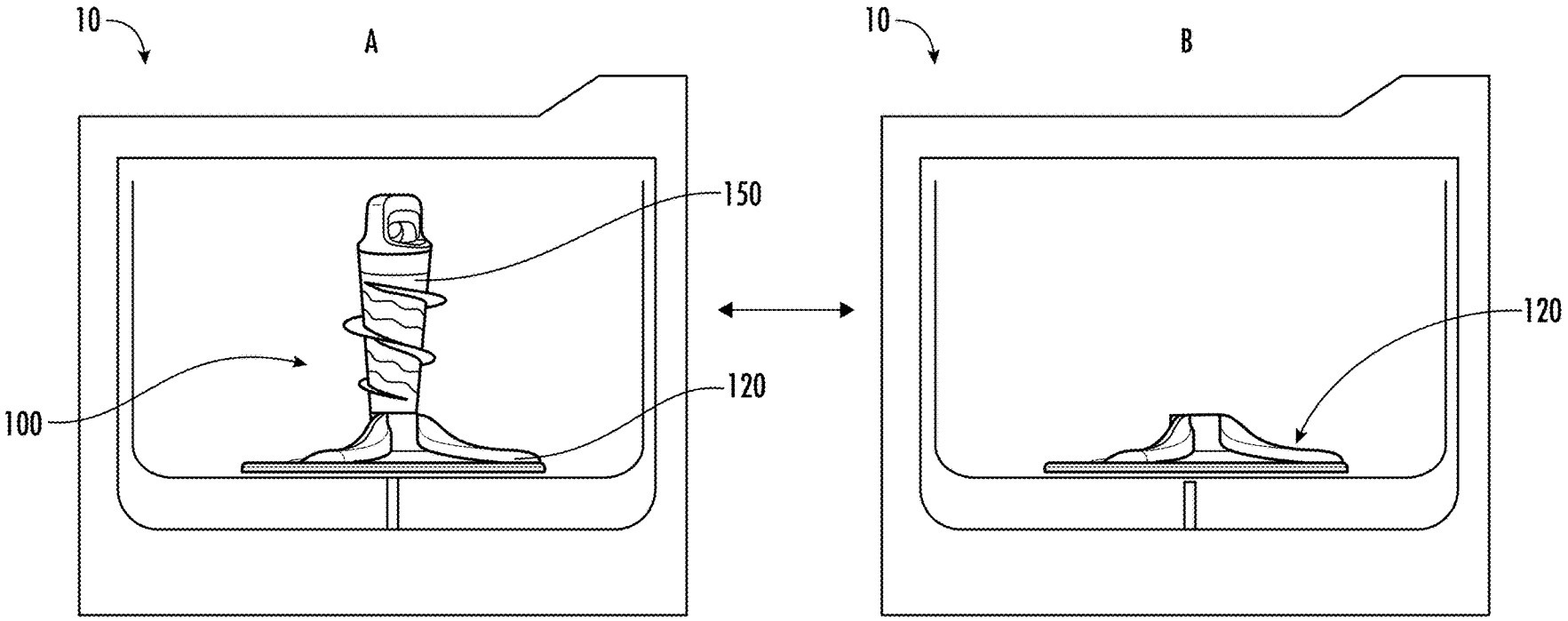
FIG. 2 illustrates a simplified cross-sectional view of the laundry treating appliance and the clothes mover of FIG. 1 with the agitator shown in attached and detached configurations.

Referring now to FIG. 2, the laundry treating appliance 10 as described herein allows the user to customize the laundry treating appliance 10 for treating the laundry load or loads to be treated. For example, the laundry treating appliance 10 can be utilized and operated with one of at least two different configurations, each utilizing a different type of clothes mover 100, the configurations selectable based on the user's treatment needs. Aspects of the laundry treating appliance 10 described herein allow the user to selectively assemble and disassemble the agitator 150, which can be thought of as forming a second clothes mover, and the impeller 120, which can be thought of as a first clothes mover, to configure the laundry treating appliance 10 into one of the two configurations. The user can customize the clothes mover 100 based on the user's personal preferences, based on the amount and/or type of mechanical action implemented by the different configurations of the clothes mover 100, and/or based on characteristics of the laundry items to be treated, non-limiting examples of which include an amount of laundry items to be treated, a size of the laundry item(s) to be treated, soil level of the laundry items, an amount and/or type of mechanical energy to be applied to the laundry items, the type of fabric of the laundry items (e.g., whether the laundry is delicate or rugged), and a fill level of liquid during treatment.

The laundry treating appliance 10 can be configured in a first configuration, illustrated by way of example as a configuration A as shown, and also as illustrated in FIG. 1, by assembling the agitator 150 with the impeller 120 within the laundry treating appliance 10. In the configuration A, the user can elect to use the clothes mover 100 that includes the agitator 150 for treating a laundry load. Such a configuration as configuration A can be useful if the user wishes to implement a treatment mode using agitator-based washing, such as for imparting significant or high quantities of mechanical action onto particularly soiled laundry items, or if the user wishes to perform deep water washing, or based on any other user preference for the clothes mover 100 and the agitator 150, such as a personal preference.

In another example, the laundry treating appliance 10 can also be configured in a second configuration, illustrated by way of example as a configuration B as shown, by assembling only the impeller 120 within the laundry treating appliance 10 and decoupling or removing the agitator 150. In the configuration B, the user elects to use the clothes mover 100 with the lower profile impeller 120 and that does not include the agitator 150 or any similar agitator post. Such a configuration as configuration B can be useful if the user wishes to implement a treatment mode using impeller-based washing, such as for low water washing, for gentler washing, wherein a lower mechanical action is imparted to the laundry items, or for washing bulky items such as blankets or comforters that could tangle around the agitator 150. Larger, bulky laundry items generally do not fit well in the basket 30 when a vertical-oriented agitator-type clothes mover 100, such as configuration A including the agitator 150, is present. Thus, the user can selectively configure the laundry treating appliance 10 to utilize the only the impeller 120 as illustrated in the configuration B, without the agitator 150 extending upward into the treating chamber 32, for use in treating large and/or bulky loads or to implement a low water treatment mode, for example, or based on another preference of the user, such as a personal preference.

The components of the laundry treating appliance 10 are configured to allow the user to configure and reconfigure the laundry treating appliance 10 into either of the agitator 150 configuration A and the impeller 120 configuration B as desired. The user can select either of the configurations A or B based on personal preference of utilizing the particular type of clothes mover 100 of configuration A or B over the other, the desired cycle of operation to be implemented, and/or characteristics of the laundry items or the laundry load.

Turning now to the process or method of configuring or re-configuring the clothes mover 100, to operate the laundry treating appliance 10 and to utilize configuration A in which the agitator 150 is present in the laundry treating appliance 10, the user can assemble the agitator 150 in the laundry treating appliance 10, such as by coupling or assembling the agitator 150 to the impeller 120 to form the clothes mover 100. The user can then utilize the laundry treating appliance 10 to implement a cycle of operation on a load of laundry in a conventional manner. When the agitator 150 is configured to be supported at least in part by the impeller 120, configuration A will include the impeller 120. Optionally, if the agitator 150 does not require the impeller 120 for support, such as when the agitator 150 can be supported by the basket 30, configuration A does not have to include the impeller 120. In this alternative configuration A, the impeller 120 does not have to be present and the clothes mover 100 can be utilized with just the agitator 150.

To operate the laundry treating appliance 10 and to utilize configuration B in which only the impeller 120 is present in the laundry treating appliance 10, the removable agitator 150 is disassembled or uncoupled from the impeller 120 by the user and removed from the laundry treating appliance 10, and the impeller 120 is assembled within the basket 30. To assemble the impeller 120 within the basket 30, the agitator 150 can be configured to separate from the impeller 120 while the impeller 120 remains coupled with the drive assembly 40 and the motor 41. The user can then utilize the laundry treating appliance 10 to implement a cycle of operation on a load of laundry in a conventional manner. The impeller 120 is configured to operate as the clothes mover 100 of configuration B, that is different from the clothes mover 100 of configuration A and independent of the agitator 150, during a cycle of operation. In this manner, the laundry treating appliance 10 can be selectively re-configured by the user between the first and second configurations as illustrated to utilize two different clothes movers 100.

Further, to configure or reconfigure the laundry treating appliance 10 from the first configuration, configuration A, to the second configuration, configuration B, the user removes or decouples the agitator 150 and sets it aside. Optionally, the laundry treating appliance 10 can be configured to facilitate storage of the removable agitator 150 when not in use. For example, the laundry treating appliance 10 can include a storage element that suspends the removable agitator 150 from the laundry treating appliance 10, such as a hook, clamp, hanger, or suspending rod. In another example, the storage element can be in the form of a shelf, drawer, or cavity configured to support the removable agitator 150. In another aspect of the disclosure, a companion laundry dryer or laundry module can include the storage element configured to store the removable agitator 150.

Figure 3:
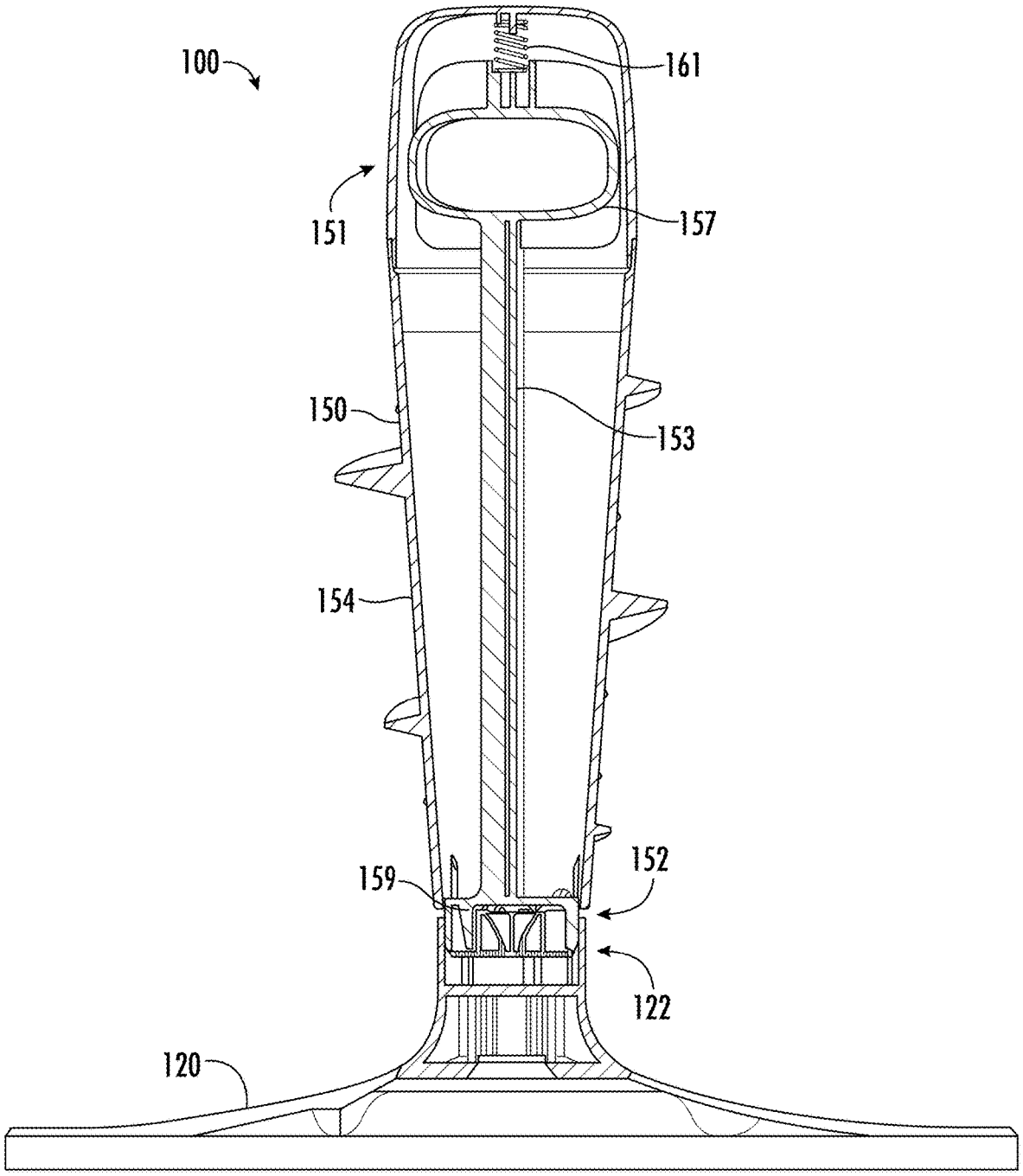
FIG. 3 illustrates a perspective cross-sectional view of an agitator coupling to an impeller for use with the clothes mover and laundry treating appliance of FIG. 1.

Referring now to FIG. 3, an agitator 150 is coupled to an impeller 120 to form the clothes mover 100 using a bayonet mount-type connection. The agitator 150 includes a grip portion, illustrated herein as a handle portion 151 at an upper end of the agitator 150 in combination with a barrel 154 extending from the handle portion 151 and forming the remainder of the agitator 150. The handle portion 151 can facilitate insertion, removal, and storage of the agitator 150 by the user by giving the user a convenient handle to grip onto and to rotate the agitator 150 as needed.

The agitator 150 further includes a handle pull locking post 153 provided within the interior of the agitator 150, such that the locking post 153 is nested within the agitator 150. The locking post 153 can include a handle pull portion 157 positioned such that the user can grip the handle portion 151 of the agitator 150 and the handle pull portion 157 of the locking post 153 at the same time. The locking post 153 further defines at least one pin 159 protruding downwardly from a lower end of the locking post 153. The at least one pin 159 can be thought of as forming a portion of the first connector 152.

The barrel 154 may also be of a generally cylindrical shape and may define a hollow interior. As illustrated, the barrel 154 has a closed bottom, generally cylindrical sides, and an open top. The barrel 154 may, in some examples, taper inward, generally reducing in diameter from the handle portion 151 to the bottom end of the barrel 154 that connects to the impeller 120. Further details of the barrel 154 are discussed herein with respect to FIG. 12.

The locking post 153 can be movable within and relative to the agitator 150, for example such that the locking post 153 is vertically slidable within and relative to the barrel 154 of the agitator 150 between a lower, locking position and a raised position. A biasing element, illustrated herein as a handle pull spring 161 that extends between the handle portion 151 and the handle pull portion 157 so as to bias the locking post 153 downwardly from the handle portion 151 and through the barrel 154 when not compressed by the user.

Figure 4:
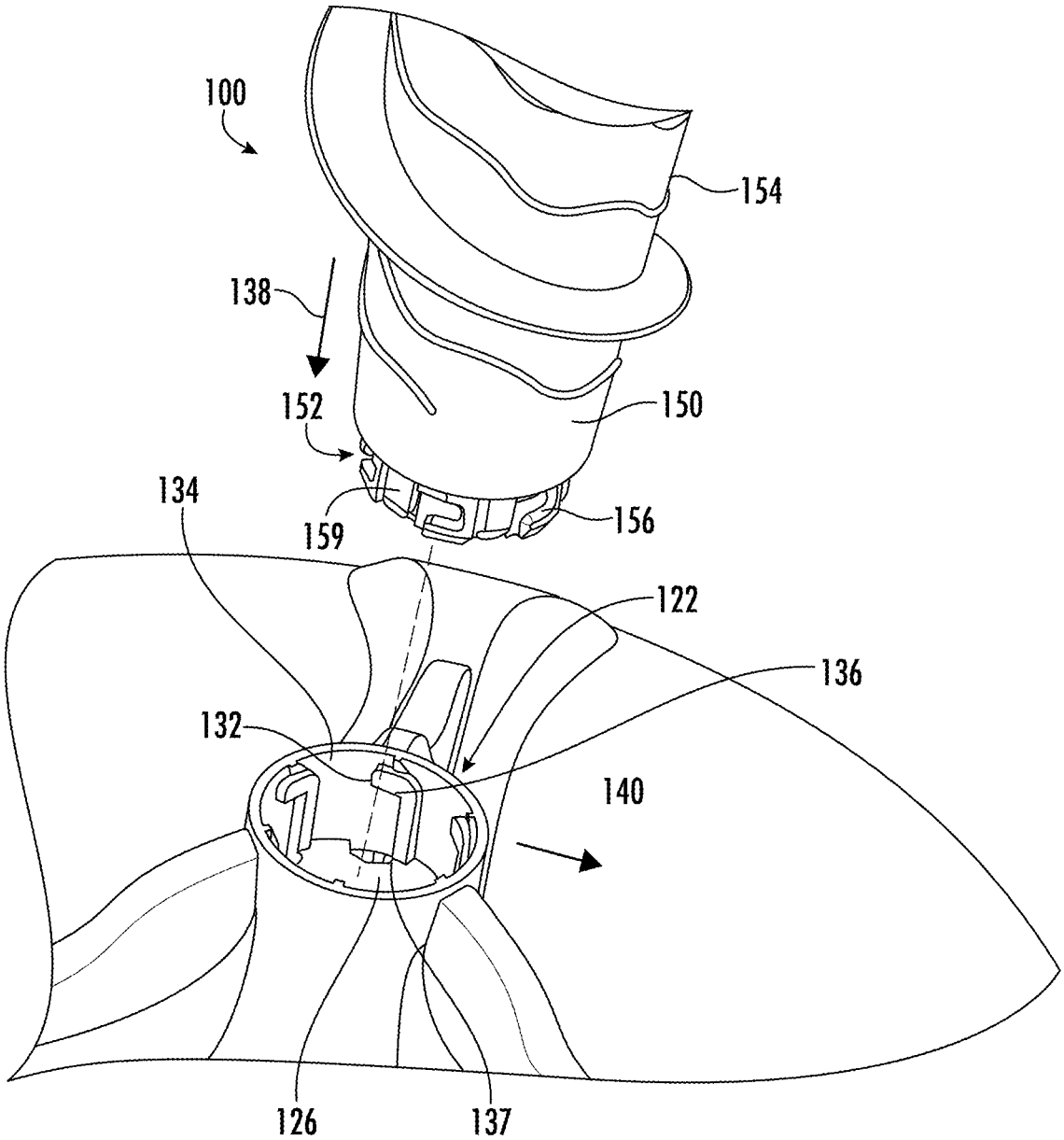
FIG. 4 illustrates a perspective view of the agitator coupling to the impeller of FIG. 3.

FIG. 4 illustrates the second connector 122 including at least one channel 132 configured to receive at least one pin 156 carried by the first connector 152. The at least one pin 159, illustrated herein as a plurality of pins 159, can protrude downwardly from the locking post 153, and thus also from the barrel 154 of the agitator 150, adjacent to at least one pin 156. In one example, the pins 159 and the pins 156 can be provided in an alternating manner, such that the pins 159 are received between the pins 156. The second connector 122 can further define at least one locking opening 137, which can be provided in a bottom wall of the second connector 122. The second connector 122 optionally includes a biasing element, such as at least one spring, within the socket 126 which is compressed within the socket 126 when the agitator 150 is coupled with the impeller 120, as illustrated in FIG. 3.

To assemble the clothes mover 100, the agitator 150 is aligned with the impeller 120 such that the at least one pin 156 is aligned with at least one opening 134 of the channels 132. It is contemplated that the user can grip the agitator 150 by the handle portion 151 during insertion of the agitator 150 into the impeller 120. Further, the user can also grip the handle pull portion 157 of the locking post 153 at the same time, compressing the handle pull spring 161 and holding the locking post 153 in the raised position. The agitator 150 is moved toward the impeller 120, as illustrated by arrow 138, to insert the first connector 152 into the second connector 122. As the first connector 152 is inserted into the second connector 122, the pin 156 travels into the channel 132. The locking post 153 can be maintained in the raised position by the grip of the user against the handle pull portion 157 and the handle portion 151. The agitator 150 is then rotated, as illustrated by arrow 140, to move the pin 156 into a lock portion 136 of the channel 132, as illustrated in FIG. 4. In one example, the at least one locking opening 137 can be positioned beneath the lock portion 136 of the channel 132. Further, the first and second connectors 152, 122 can be positioned and sized such that the locking post 153 must be held in the raised position to prevent the pins 159 from protruding downwardly beyond the pins 156 and in order for the agitator 150 to be rotated as illustrated by arrow 140.

Figure 5:
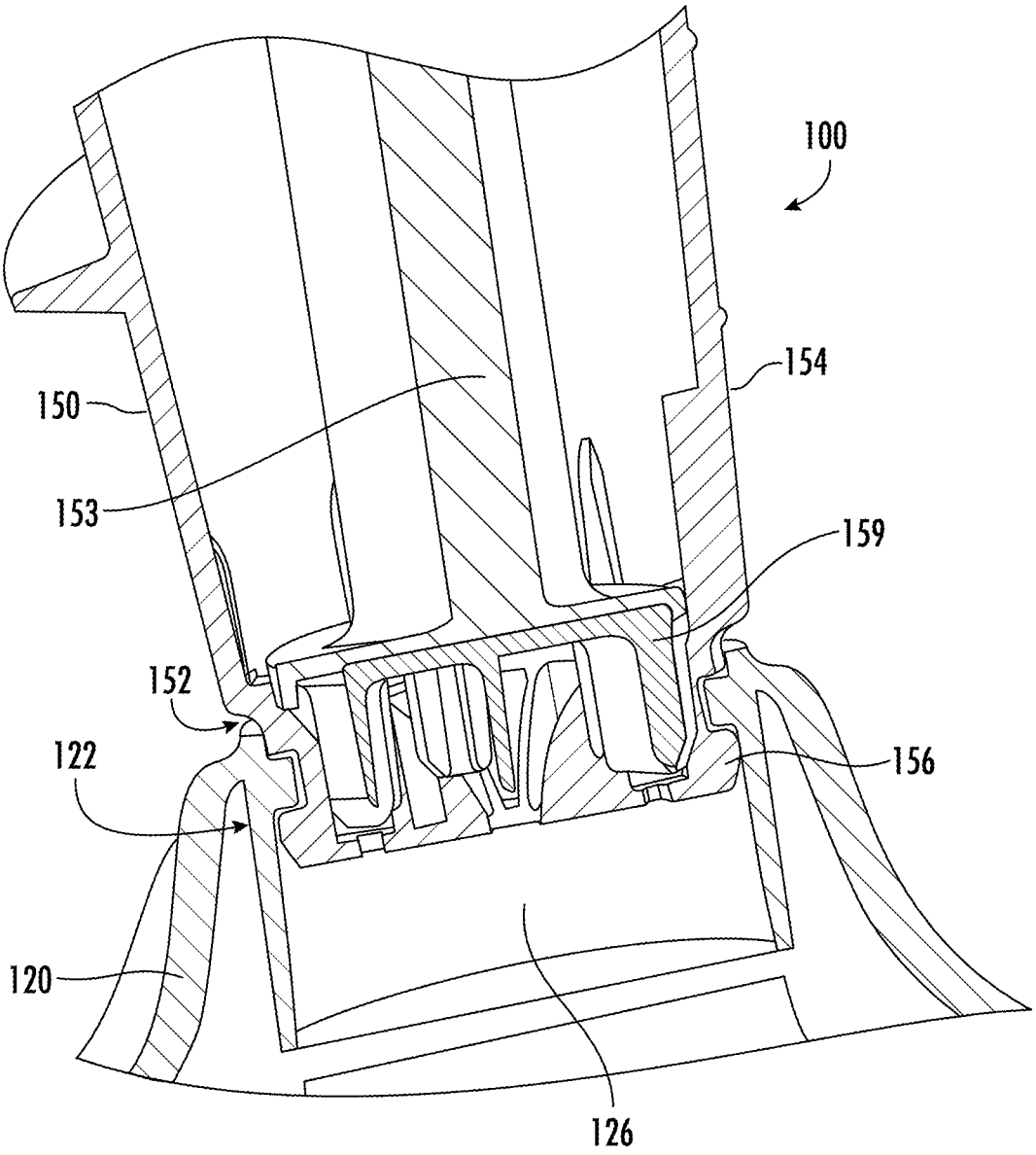
FIG. 5 illustrates a cross-sectional view of the agitator coupling to the impeller of FIG. 3 in a first position.

In FIG. 5, the agitator 150 is coupled with the impeller 120, with the pins 156 engaging the lock portion 136 of the channel 132. The locking post 153 is still provided in the raised position, such that the pins 159 do not extend downwardly beyond the pins 156. When the agitator 150 is coupled with the impeller 120, a biasing element of the impeller 120, such as a spring, biases the agitator 150 away from the impeller 120, facilitating maintaining the pin 156 in the lock portion 136. The biasing element applies a force that presses the agitator 150, and thus the pin 156, upward, which presses the pin 156 upward against the wall forming the lock portion 136. Biasing the pin 156 against the wall of the lock portion 136 can inhibit unintended rotation of the agitator 150 relative to the impeller 120 during a cycle of operation into a position in which the pin 156 is aligned with the channel opening 134, which could result in unintended uncoupling of the agitator 150 from the impeller 120.

Figure 6:
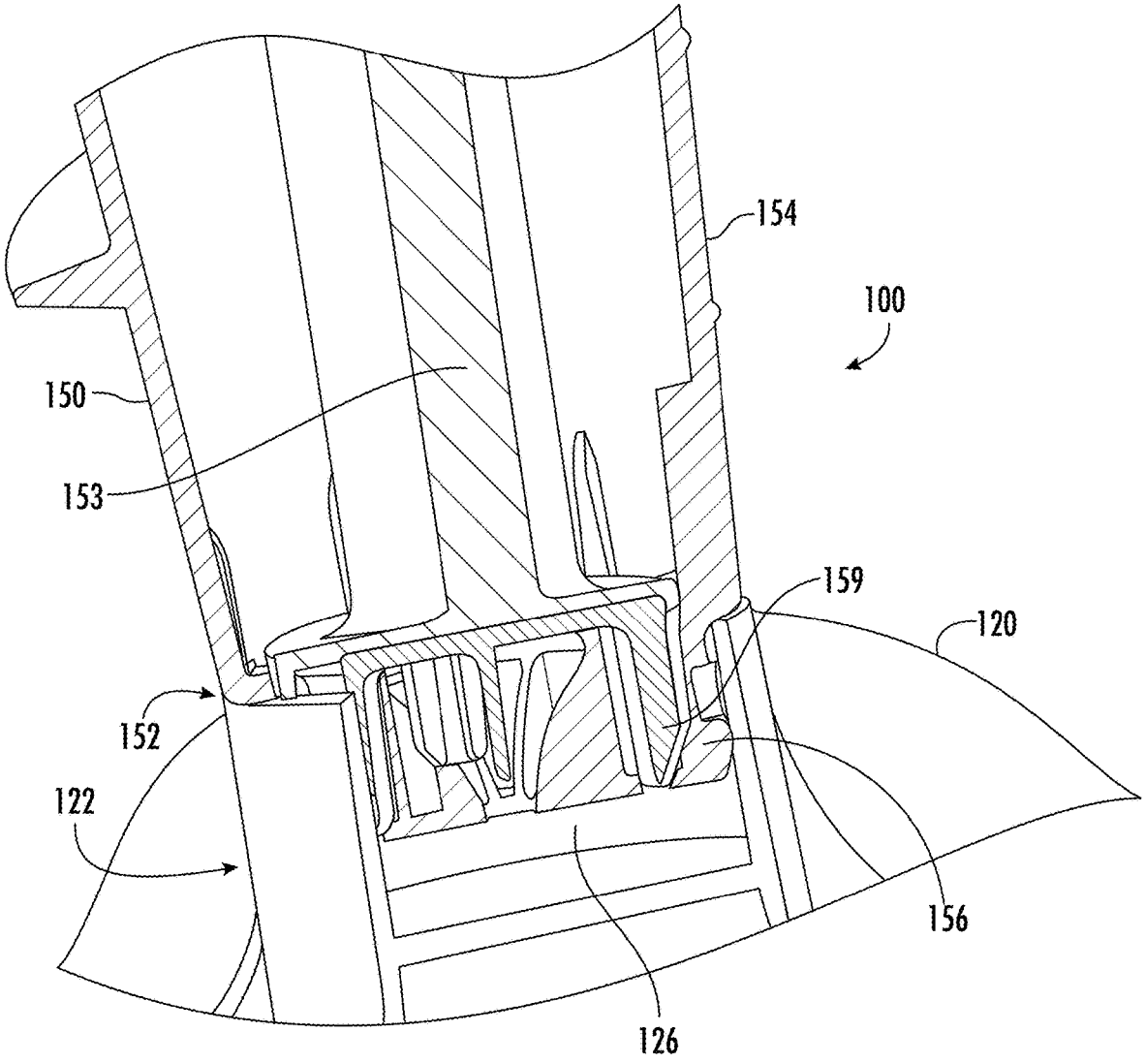
FIG. 6 illustrates a cross-sectional view of the agitator coupling to the impeller of FIG. 3 in a second position.

Referring now to FIG. 6, and in order to further inhibit unintended rotation of the agitator 150 relative to the impeller 120 during a cycle of operation, once the agitator 150 has been rotated to move the pins 156 into the lock portion 136, the pins 159 of the locking post 153 overlie and are aligned with the locking openings 137. The user can release the handle pull portion 157 and the handle portion 151, allowing the handle pull spring 161 to bias the locking post 153 downwardly. As the handle pull spring 161 biases the locking post 153 downwardly, the pins 159 are moved downwardly to be inserted into and received within the locking openings 137. When the pins 159 are received within the locking openings 137, unintended rotation of the agitator 150 relative to the impeller 120 during a cycle of operation is inhibited. Further, the engagement between the pins 156 and the lock portion 136 prevents unintended vertical movement of the agitator 150 relative to the impeller 120.

To uncouple the agitator 150 from the impeller 120, the user can again grip the agitator 150 by the handle portion 151 and can also grip the handle pull portion 157 of the locking post 153 and compress the handle pull spring 161 to hold the locking post 153 in the raised position, withdrawing the pins 159 from the locking openings 137, to permit rotational movement of the agitator 150. The agitator 150 can then be rotated in the opposite direction of arrow 140 of FIG. 4 until the pins 156 are no longer aligned with the lock portion 136 and are instead aligned with the at least one opening 134 of the channels 132. When the pins 156 are aligned with the at least one opening 134, the agitator 150 can be withdrawn in the opposite direction of arrow 138 of FIG. 4.

FIGS. 7-14 describe further details of the attachable clothes retriever functionality of the removable agitator 150. As explained in detail herein, the agitator 150 comprises a hook 202 that may be used to pick up clothes or other laundry items within the drum or laundry basket. The hook 202 defines a generally J-shaped structure for grabbing, picking up, and holding laundry items. The hook 202 may include a shank portion and a curved portion that terminates in a free end. The hook 202 may be attached to the agitator 150 in either of two different configurations: (A) a stowed configuration or (B) a grabbing configuration. The hook 202 may be in the stowed configuration regardless of whether the agitator 150 coupled to the impeller 120, but the hook 202 may be in the grabbing configuration only when the agitator 150 is decoupled from the impeller 120.

Figure 7:
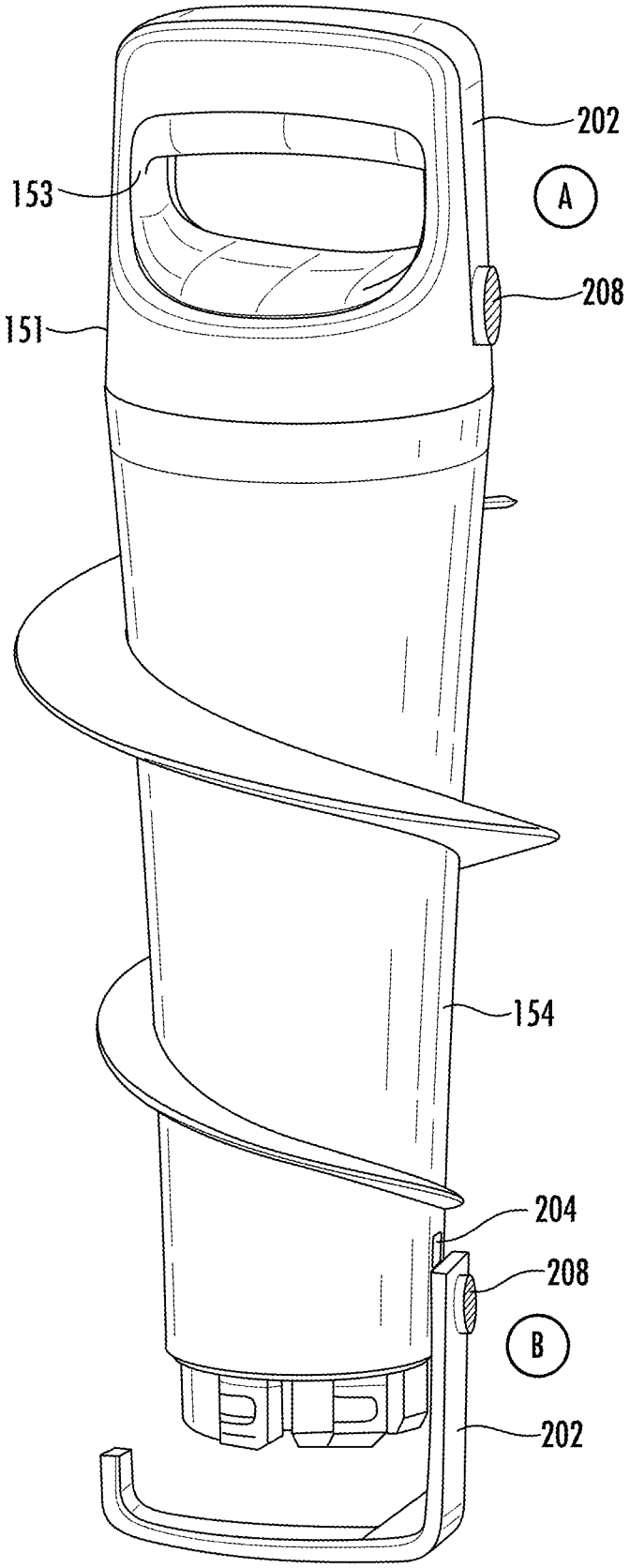
FIG. 7 illustrates a perspective view of a hook in selective attachment to the agitator in a stowed configuration (A) and/or in a grabbing configuration (B)

As shown in FIG. 7, in the stowed configuration (A), the hook 202 is nested into the handle portion 151 when not in use. In the stowed configuration, the free end of the hook 202 points downward, and the shank portion of the hook 202 is aligned parallel to a side of the handle portion 151, with the hook 202 being substantially flush with the exterior surface of the handle portion. In the grabbing configuration (B), the hook 202 is attached to the lower end of the agitator 150 to aid in picking up clothes or other laundry items. In the grabbing configuration, the free end of the hook 202 points upward, and the shank portion extends below the lower end of the barrel 154. While both possibilities are shown in FIG. 7, it should be noted that the hook 202 would typically be assembled in one of the configurations at a time but not both.

Figure 8:
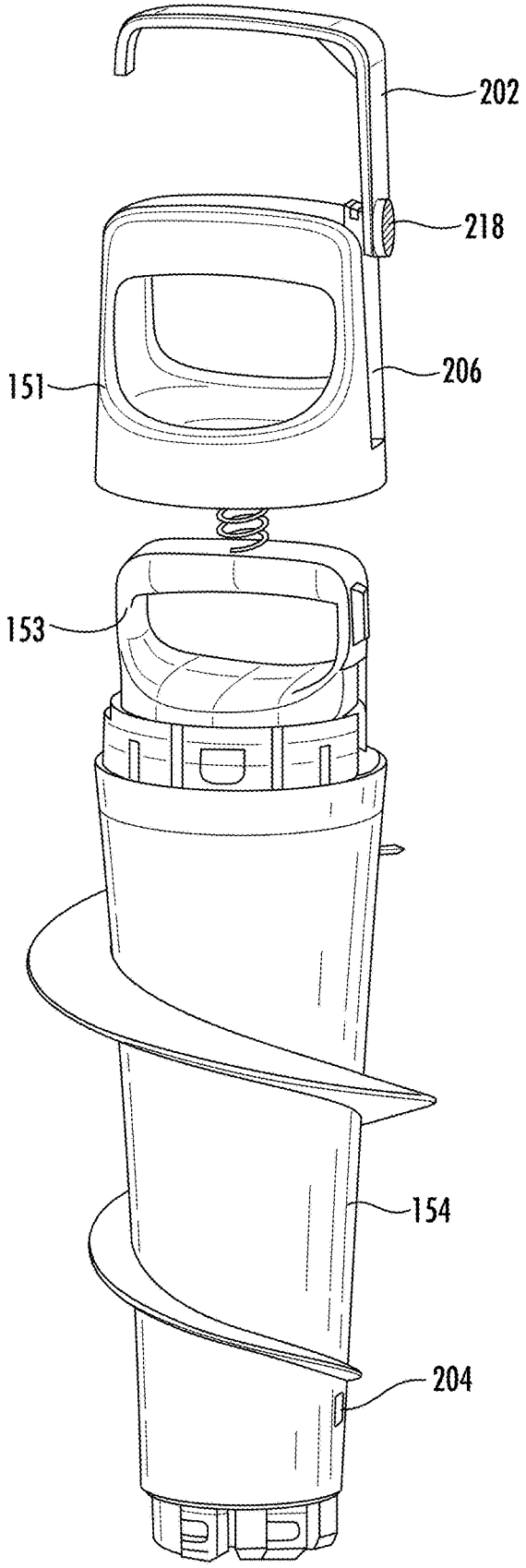
FIG. 8 illustrates an exploded perspective view of the hook, handle portion, locking post, and barrel with the hook in the stowed configuration.

FIG. 8 illustrates an exploded perspective view of the hook 202, handle portion 151, locking post 153, and barrel 154 with the hook 202 in the stowed configuration. As shown, the barrel 154 defines an attachment aperture 204 which may be used for attaching the hook 202 in the grabbing configuration. Additionally, the handle portion 151 defines a cavity 206 into which the hook 202 may be placed in the stowed configuration when not in use. The cavity 206 of the handle portion 151 also defines an attachment aperture 207 for securing the hook 202 within the cavity 206 when not in use.

A latch mechanism 208 is utilized to lock the hook 202 into the attachment aperture 204 when in the grabbing configuration, as well as to lock the hook 202 into the attachment aperture 207 when in the stowed configuration. The latch mechanism 208 allows for easy movement of the hook 202 between the stowed and grabbing configurations using pressing and releasing actions. The latch mechanism 208 may be pressed to allow for movement of the hook 202 in or out of the attachment aperture 204 of the barrel 154 (as explained with respect to FIGS. 8, 12, and 14) as well as in or out of the attachment aperture 207 of the handle portion 151 (as explained with respect to FIGS. 10 and 13). The latch mechanism 208 may be released to secure the hook 202 into the attachment aperture 204 or attachment aperture 207.

Figure 9:
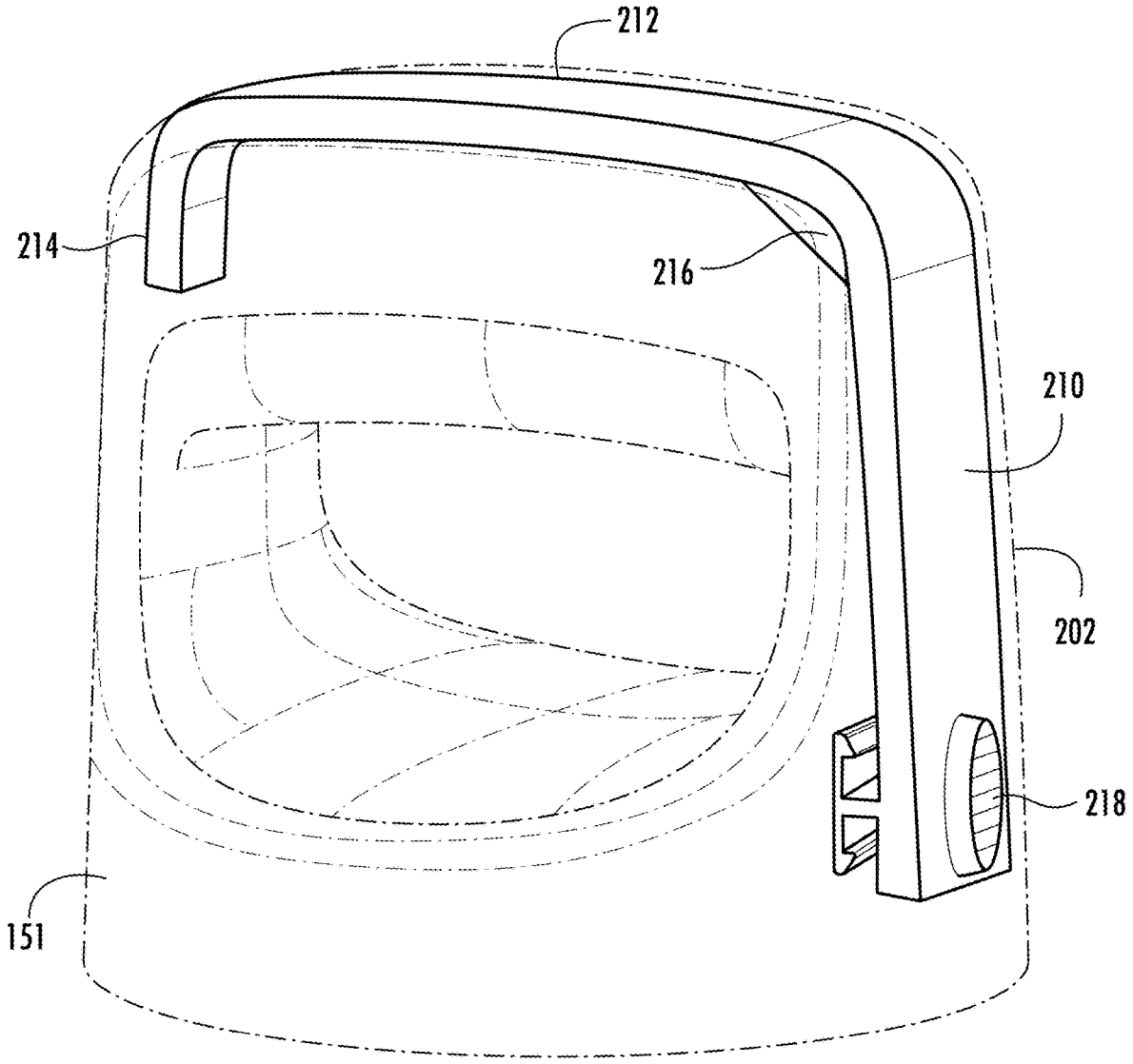
FIG. 9 illustrates a perspective view of the handle portion and hook in the stowed configuration.

FIG. 9 illustrates a perspective view of the handle portion 151 and hook 202 in the stowed configuration. The handle portion 151 is shown in FIG. 9 as being partially transparent for sake of explanation, to better show the positioning of the elements of the hook 202. In this view, it is shown that the hook 202 is securely nested within the cavity 206 of the handle portion 151, with its exterior surface flush with the handle portion 151 to avoid obstruction or snagging.

The body of the hook 202 comprises a base 210 for mounting or attachment, combined with a curved portion 212 designed to hold or support objects. The free end of the hook 202 opposite the base 210 may define a bend or lip 214 to complete the mouth or gap of the hook 202. This structure aids in the ability to pick up laundry items and serves to prevent items from slipping off the hook 202 once captured. The curved portion 212 is shown as a smooth slightly angled curve, conforming with the exterior contour of the handle portion 151. In some examples, a rib 216 may connect the throat side of the base 210 to the curved portion 212 to impart additional rigidity. The base 210 may also define a slide 218 for engaging the latch mechanism 208 for selectively securing the hook 202 to the handle portion 151 (or to the barrel 154).

Figure 10:
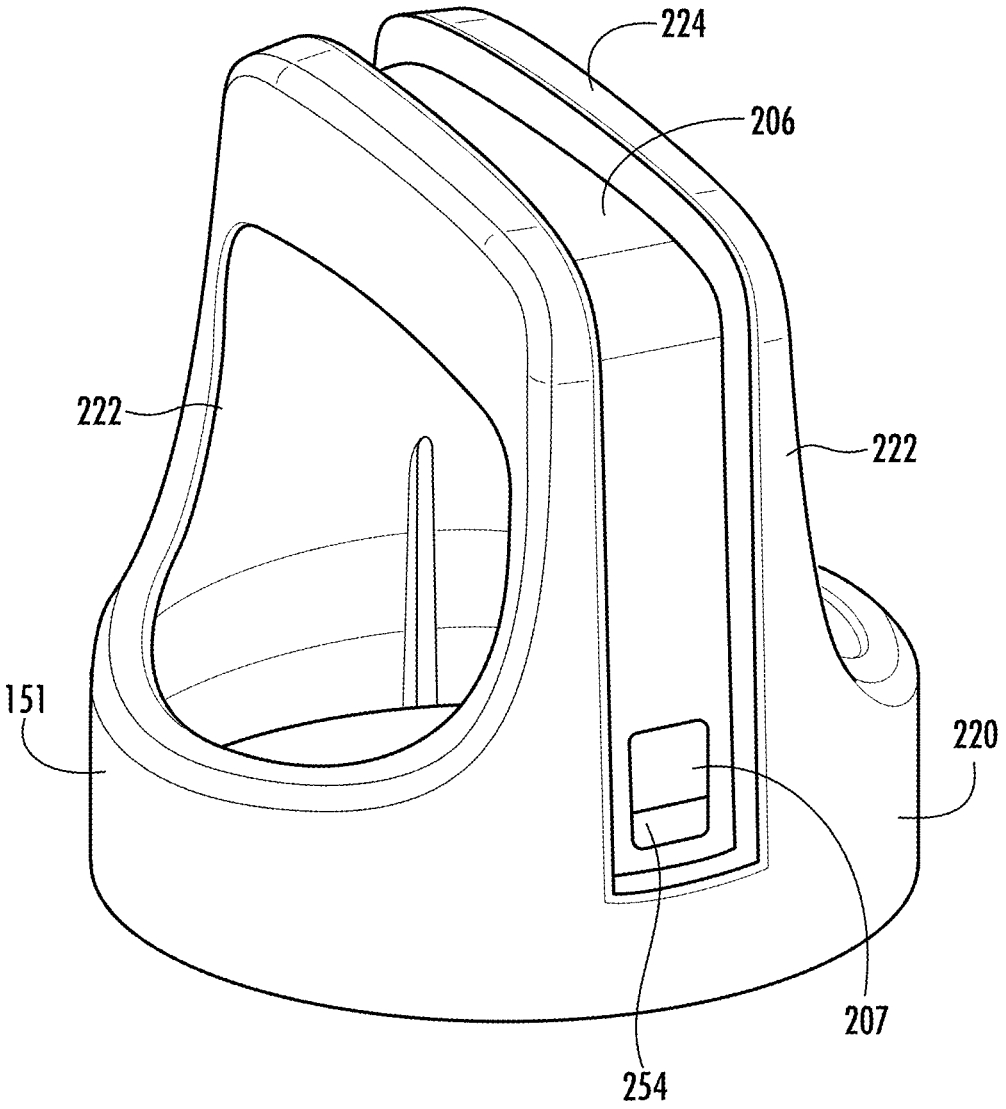
FIG. 10 illustrates a perspective view of the handle portion with the hook uninstalled.

FIG. 10 illustrates a perspective view of the handle portion 151 with the hook 202 uninstalled. As shown, the handle portion 151 comprises a hollow cylindrical base 220 sized for attachment to the upper end of the barrel 154. In addition, the handle portion 151 comprises handle supports 222 extending vertically upwards from opposite sides of the hollow cylindrical base 220 (here 180 degrees apart), terminating in a handle top 224 connecting the handle supports 222 together. With the hook 202 removed, it can be seen that the exterior of the handle top 224 and handle supports 222 collectively define the cavity 206, which provides a trough-like groove or recess sized to receive the hook 202 in the stowed configuration. Generally, the cavity 206 defines an area that is complementary or similar in shape and depth to the hook 202. In particular, the depth of the cavity 206 is sized to the depth of the hook 202, while the width of the cavity 206 is sized to the width of the hook 202.

As noted above, the cavity 206 also defines an attachment aperture 207. As shown, the attachment aperture 207 defines a through hole, sized for receiving a slide 218 of the latch mechanism 208 of the hook 202. Further aspects of the slide 218 are discussed with respect to FIGS. 12-13.

Figure 11:
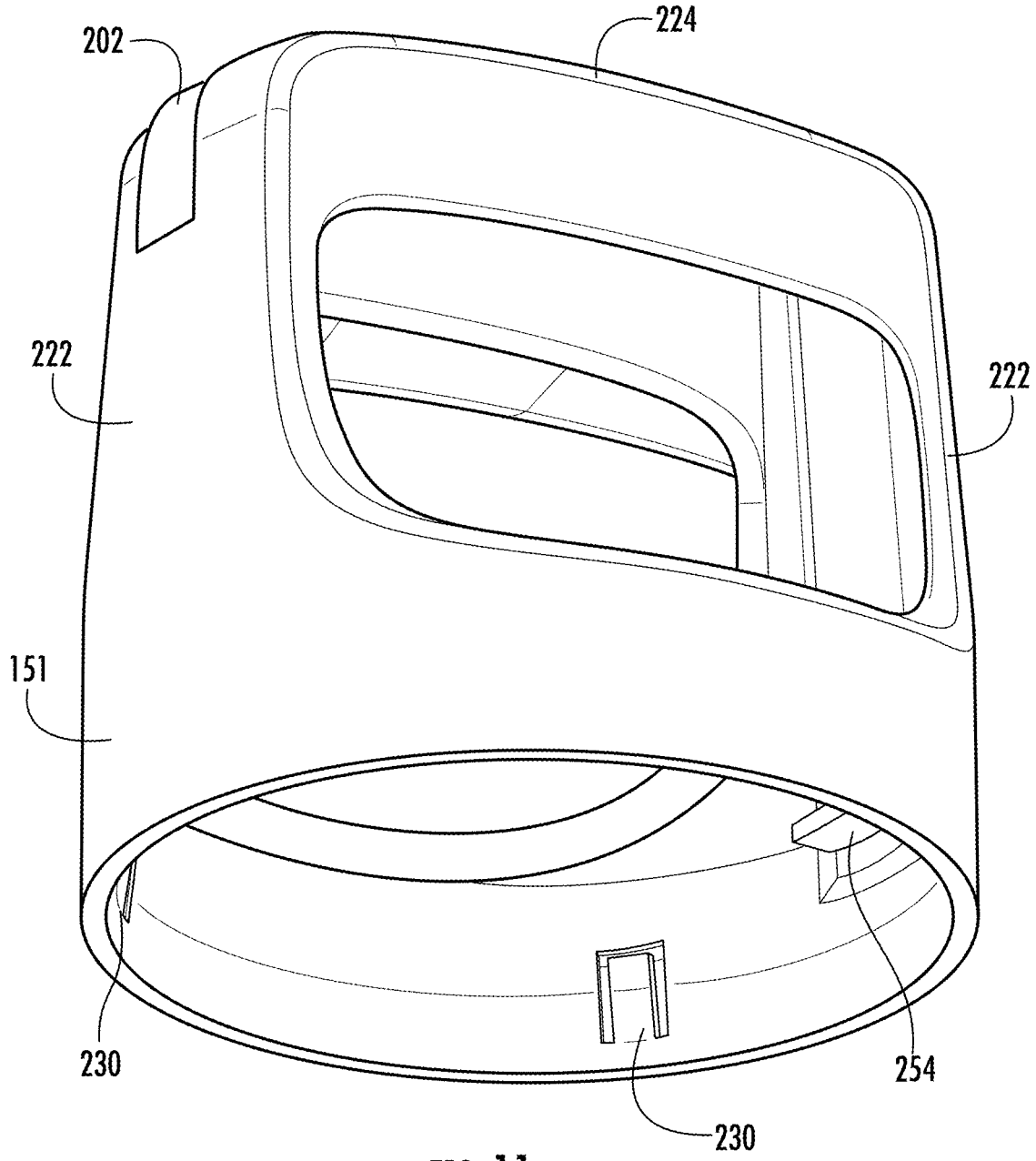
FIG. 11 illustrates a perspective view of the handle portion with the hook in the stowed configuration.

FIG. 11 illustrates a perspective view of the handle portion 151 with the hook 202 in the stowed configuration. As shown, in the stowed configuration within the cavity 206, the hook 202 is substantially flush with the handle portion 151, thereby completing the smooth exterior surface of the handle portion 151 and preventing the hook 202 from inadvertently snagging or catching clothes items when in the stowed configuration.

Figure 12:
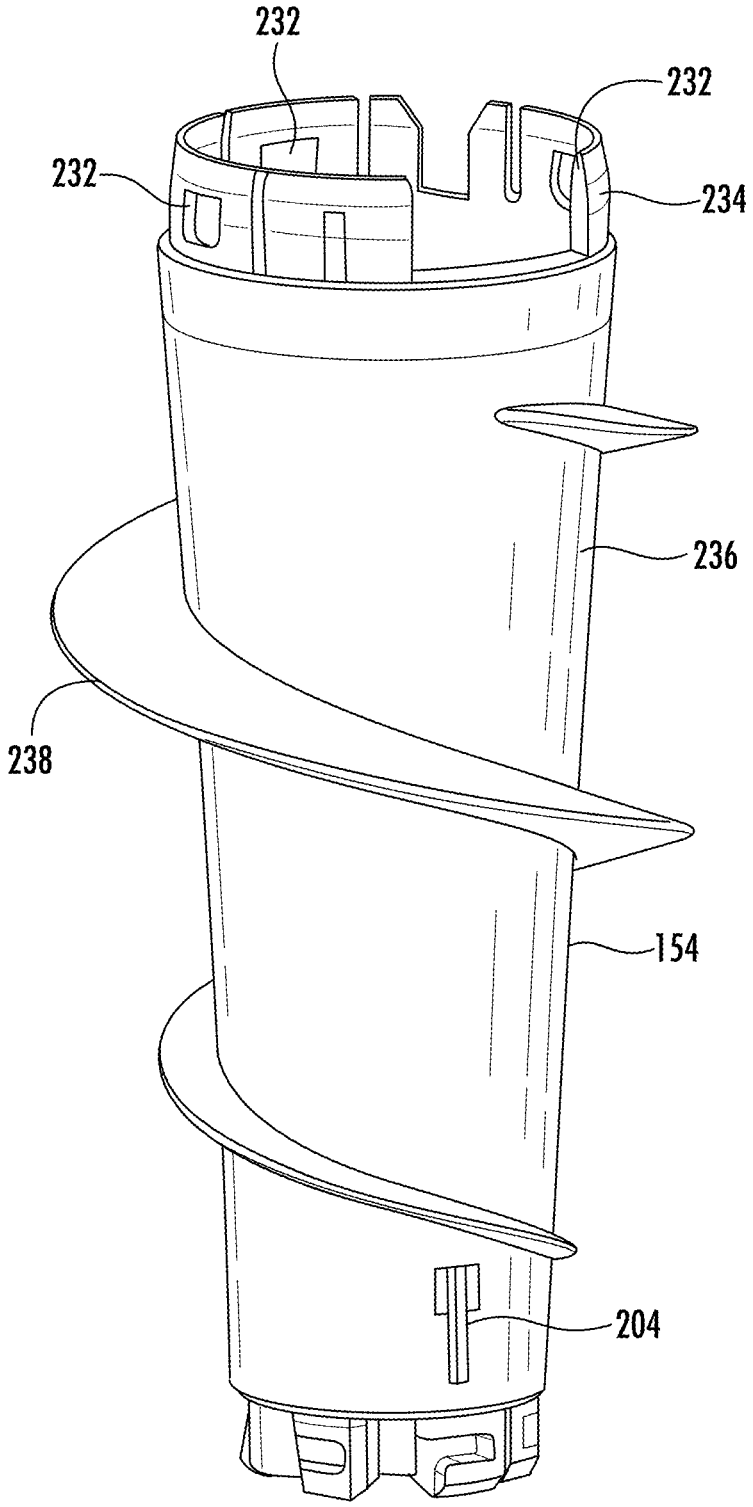
FIG. 12 illustrates a perspective view of the barrel of the agitator.

FIG. 12 illustrates a perspective view of the barrel 154 of the agitator 150. With continuing reference to FIG. 11, the interior of the hollow cylindrical base 220 may define a series of snaps 230 that, as shown in FIG. 12, engage into a corresponding series of apertures 232 in an annular snap fit portion 234 at the upper end of the barrel 154. When inserted and snapped onto the annular snap fit portion 234, the exterior of the hollow cylindrical base 220 of the handle portion 151 may form a generally flush exterior with a main body 236 of the barrel 154.

The main body 236 of the barrel 154 may define a configuration of vanes 238 that impart mechanical action to laundry items, enhancing the cleaning process and providing improved cleaning performance, especially for soiled loads. As shown, the example barrel 154 includes a single spiral of vanes 238 that extend radially outward and around from the cylindrical body of the barrel 154. However, it should be noted that other quantities or arrangements of vanes 238 may also be used, depending on the specific application. Towards the lower end of the barrel 154, the attachment aperture 204 may be defined through which the slide 218 of the hook 202 may be secured in the grabbing configuration. The attachment aperture 204 may be placed to allow for the hook 202, in the grabbing configuration, to extend below the lower extent of the barrel 154.

Figure 13:
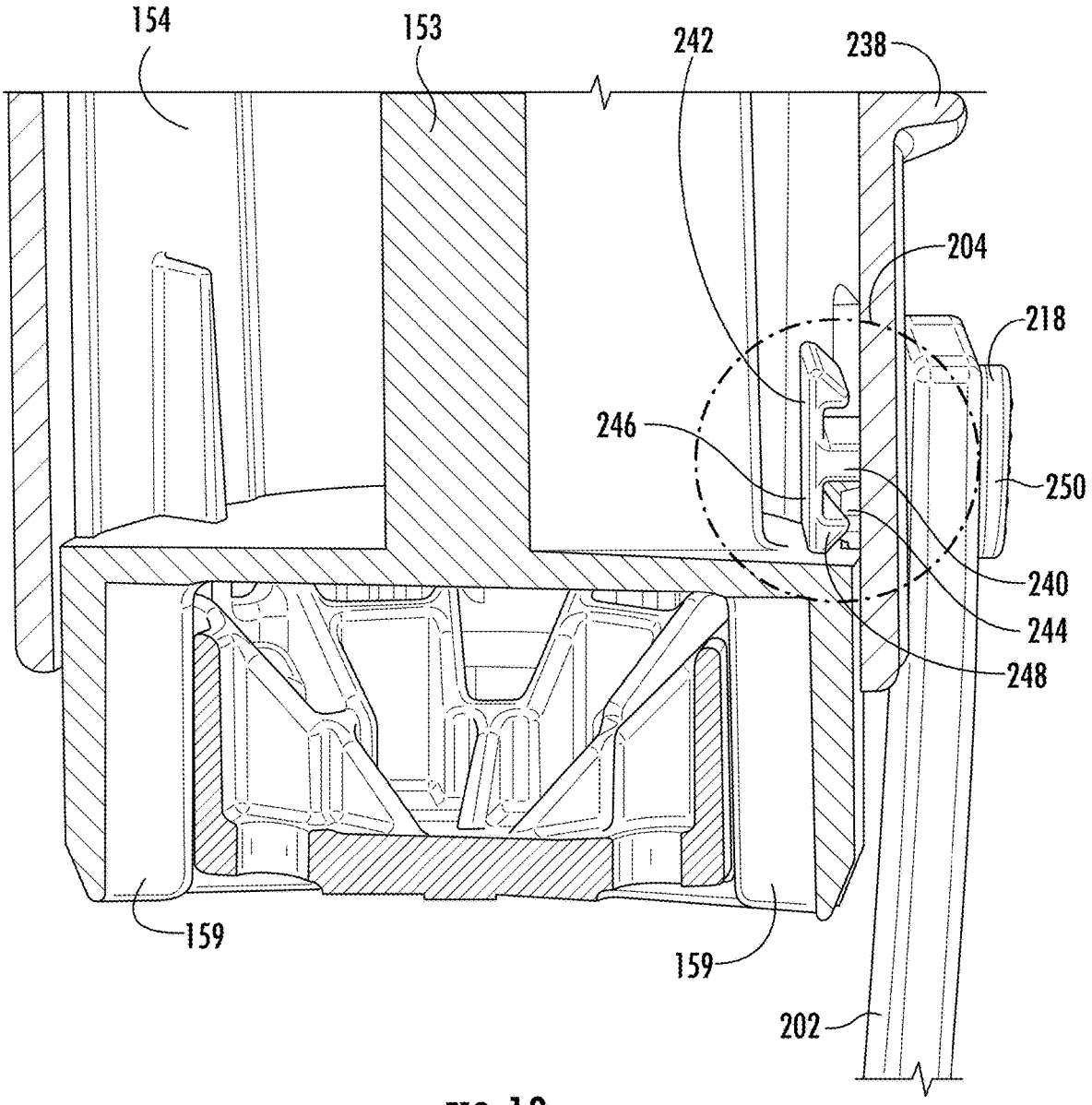
FIG. 13 illustrates a perspective cutaway view of the attachment of the hook to the barrel in the grabbing configuration (B)

FIG. 13 illustrates a perspective cutaway view of attachment of the hook 202 to the barrel 154 in the grabbing configuration (B). As shown, the slide 218 of the hook 202 is inserted into the attachment aperture 204 of the barrel 154. In further detail, the slide 218 comprises an elongate fastener body 240 extending laterally through a through hole (not shown) of the hook 202 located in the base 210. Moreover, the interior end of the fastener body 240 defines a fastener 242 for securing the hook 202 onto a barrel standoff 244 formed into the interior of the barrel 154.

The fastener 242 may define a barrel attachment member 246 that extends transverse to the elongate fastener body 240, with the free end of the barrel attachment member 246 defining a wedge 248 or other retaining element facing towards the interior wall of the barrel 154 and angled towards the free end of the barrel attachment member 246. This wedge 248 structure may be used to securely engage the barrel standoff 244 to lock the hook 202 in place.

The barrel standoff 244 may be a peg or other feature positioned to catch between the wedge 248 and the fastener body 240 of the fastener 242. As shown, the barrel standoff 244 has a rectangular prism shape sized to fit within the gap between the wedge 248 and the fastener body 240, but alternative shapes or designs may be used, depending on the specific design requirements. In some cases, the peg may be unitary to and molded into the barrel 154.

The exterior end of the fastener body 240 defines a button 250 that may be pressed to move the slide 218 laterally inwards, thereby releasing the barrel standoff 244 from the fastener 242 and allowing the hook 202 to be removed from the attachment aperture 204 of the barrel 154. This simple press-button mechanism allows for easy removal of the hook 202 when transitioning between configurations. While not shown, a biasing element (such as a spring located between the inner face of the button 250 and the outer face of the hook base 210) may be provided to bias the slide 218 into the locked position.

The wedge 248 may be positioned along the barrel attachment member 246 such that the barrel standoff 244 can be locked in a gap between the fastener body 240 and the face of the wedge 248 parallel to the fastener body 240, preventing movement of the hook 202 in the grabbing configuration. The wedge 248 may also facilitate the smooth removal of the hook 202 when the button 250 of the slide 218 is pressed, as the angled face may ride on the end of the barrel standoff 244 to guide the hook 202 out of the attachment aperture 204.

Variations on the attachment of the hook 202 to the barrel 154 are possible. In an example, the latch mechanism 208 may be attached to the handle pull locking post 153 instead of to the barrel 154. In such an example, the barrel 154 may define a passthrough to allow for the fastener body 240 to pass into the interior of the barrel 154 for attachment to the handle pull locking post 153 to an attachment aperture 204 defined by the handle pull locking post 153. Such an example may be advantageous, for example, to allow for the hook 202 to move with the handle pull locking post 153, thereby providing additional dexterity in the operation of the hook 202.

Figure 14:
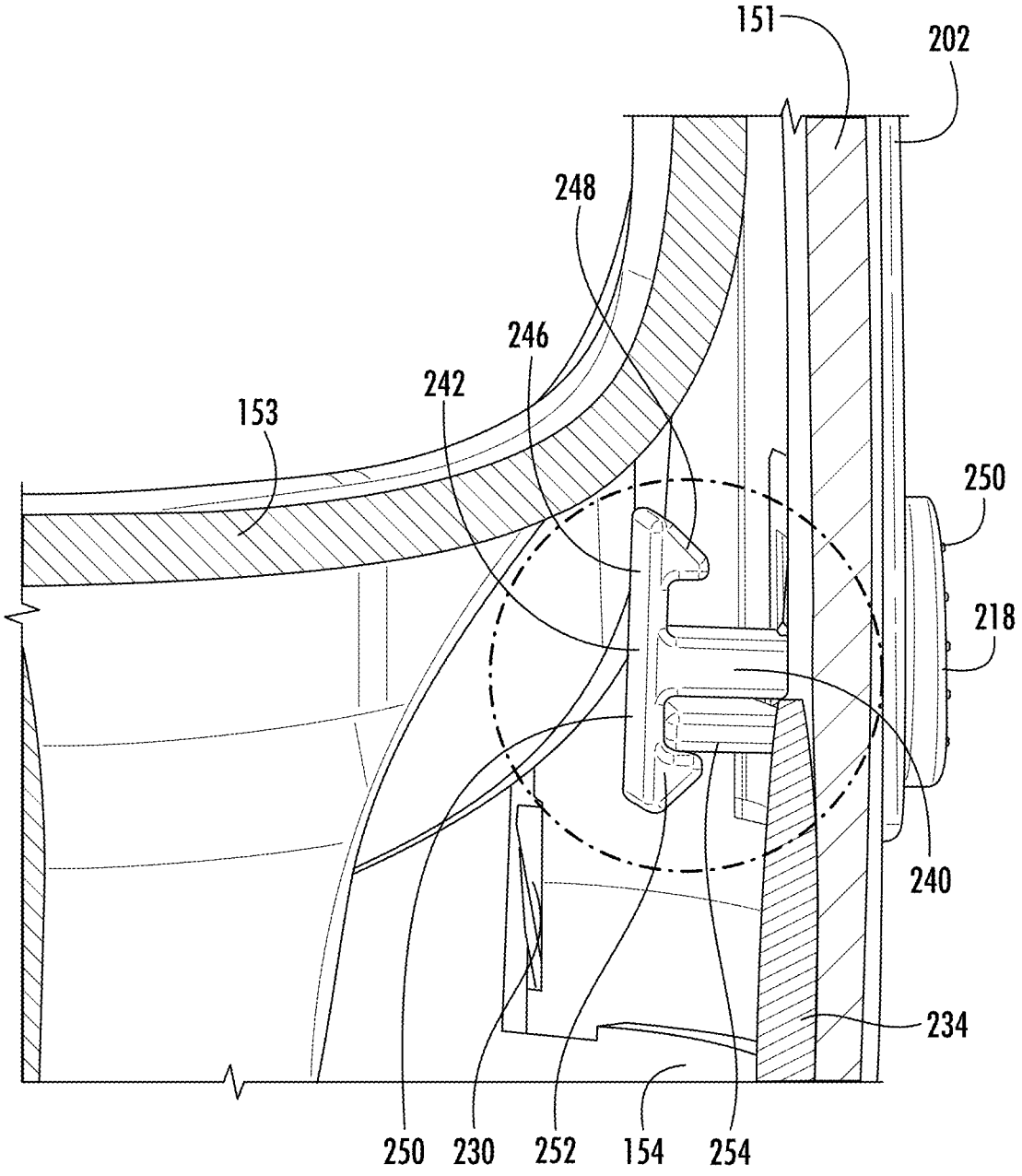
FIG. 14 illustrates a perspective cutaway view of the attachment of the hook to the handle portion in the stowed configuration (A)

FIG. 14 illustrates a perspective cutaway view of attachment of the hook 202 to the handle portion 151 in the stowed configuration (A). Similar to the attachment of the slide 218 of the hook 202 to the barrel 154, the slide 218 of the hook 202 may also be inserted into the attachment aperture 207 of the handle portion 151.

The interior of the handle portion 151 may define a handle standoff 254 formed into the interior of the handle portion 151. As shown, the handle standoff 254 is in a location opposite to the location of the barrel standoff 244 relative to the slide 218 of the hook 202. Because of this, the fastener 242 may also define a handle attachment member 251 that extends transverse to the fastener body 240, in the opposite direction from the barrel attachment member 246.

The free end of the handle attachment member 251 may also define a wedge 252 or other retaining element, here again facing towards the interior wall of the handle portion 151 and angled towards the free end of the handle attachment member 251. The wedge 252 may be positioned along the handle attachment member 251 such that the handle standoff 254 can be locked in a gap between the fastener body 240 and the face of the wedge 252 parallel to the fastener body 240, preventing movement of the hook 202 in the stowed configuration. This configuration ensures that the hook 202 is firmly secured within the cavity 206 of the handle portion 151 when not in use.

Similar to release of the hook 202 form the barrel 154, the button 250 may be pressed to move the slide 218 laterally inwards, thereby releasing the handle standoff 254 from the fastener 242 and allowing the hook 202 to be removed from the attachment aperture 207 of the handle portion 151. This press-button release mechanism therefore provides easy detachment of the hook 202 from the stowed position, allowing for quick transitions between stowed and grabbing configurations.

FIGS. 15A-J collectively illustrates a sequence of operations for the transitioning of the agitator 150 between the stowed configuration (A) and the grabbing configuration (B). Starting from FIG. 15A and moving through to FIG. 15J, the agitator 150 is transitioned between the grabbing configuration (A) and the stowed configuration (B). Starting from FIG. 15J and moving backwards through to FIG. 15A, the agitator 150 is transitioned between the grabbing configuration (B) and the stowed configuration (A).

Figure 15A:
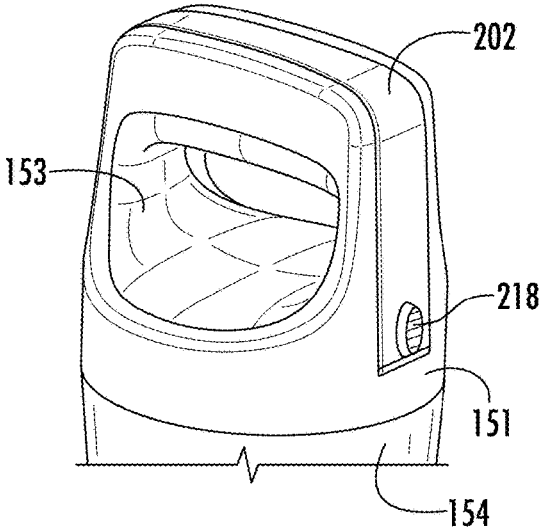
FIG. 15A illustrates a first portion of a sequence for the transitioning of the agitator between the stowed configuration (A) and the grabbing configuration (B)
Figure 15B:
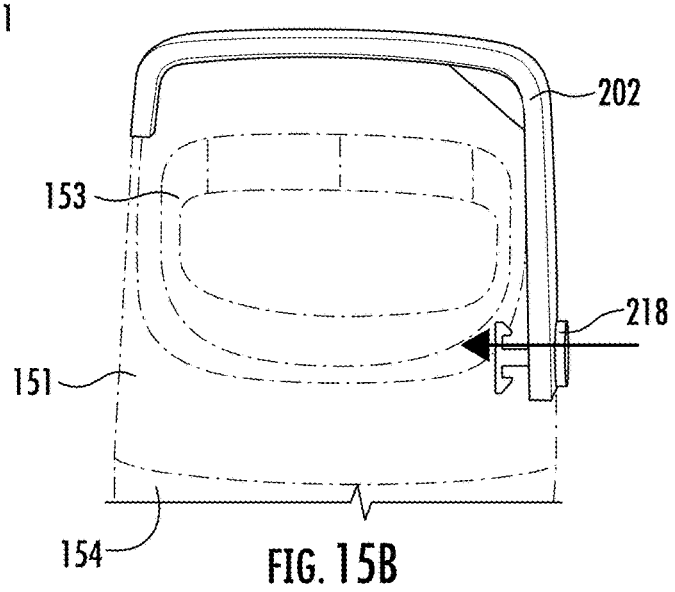
FIG. 15B illustrates a second portion of the sequence for the transitioning of the agitator between the stowed configuration (A) and the grabbing configuration (B)

Beginning with the process for transitioning of the agitator 150 from the stowed configuration (A) to the grabbing configuration (B), at FIG. 15A the hook 202 is located in the cavity 206 of the handle portion 151 in the stowed configuration (A). The latch mechanism 208 provides for locking of the hook 202 into the handle portion 151. As shown in FIG. 15B, the button 250 of the latch mechanism 208 is pressed to cause the fastener body 240 of the hook 202 to move inwards further into the attachment aperture 207 of the handle portion 151. This may accordingly cause the wedge 252 of the handle attachment member 251 to become freed from the handle standoff 254 inside the handle portion 151. Once disengaged, the hook 202 may be removed for use.

Figure 15C:
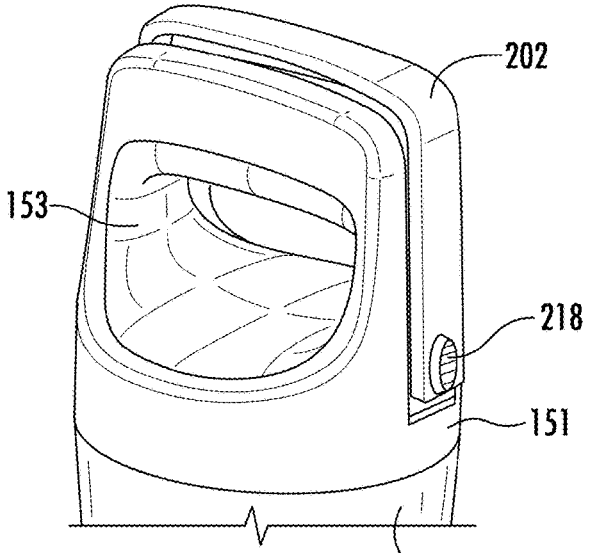
FIG. 15C illustrates a third portion of the sequence for the transitioning of the agitator between the stowed configuration (A) and the grabbing configuration (B)
Figure 15D:
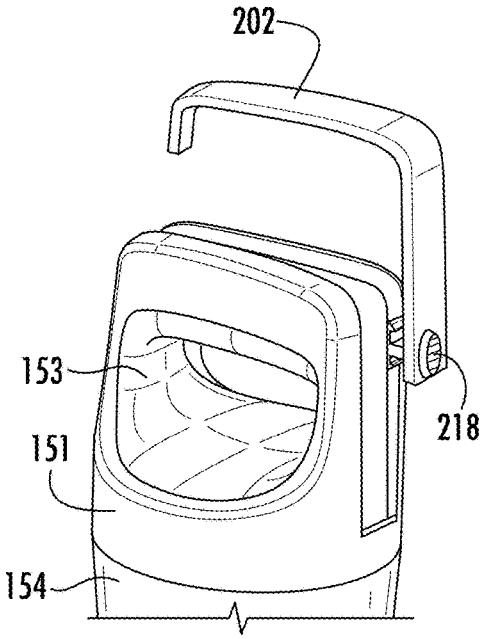
FIG. 15D illustrates a fourth portion of the sequence for the transitioning of the agitator between the stowed configuration (A) and the grabbing configuration (B)
Figure 15E:
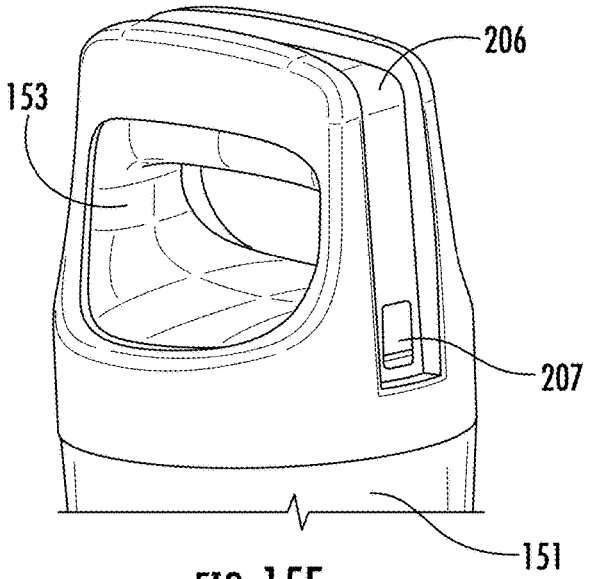
FIG. 15E illustrates a fifth portion of the sequence for the transitioning of the agitator between the stowed configuration (A) and the grabbing configuration (B)
Figure 15F:
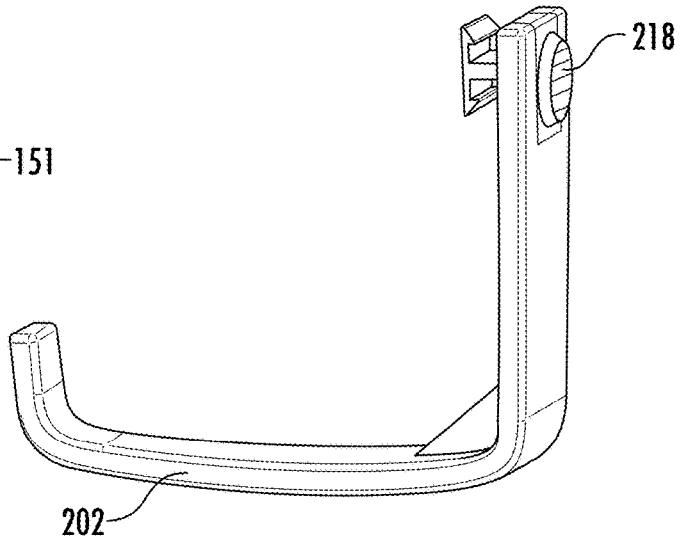
FIG. 15F illustrates a sixth portion of the sequence for the transitioning of the agitator between the stowed configuration (A) and the grabbing configuration (B)
Figure 15G:
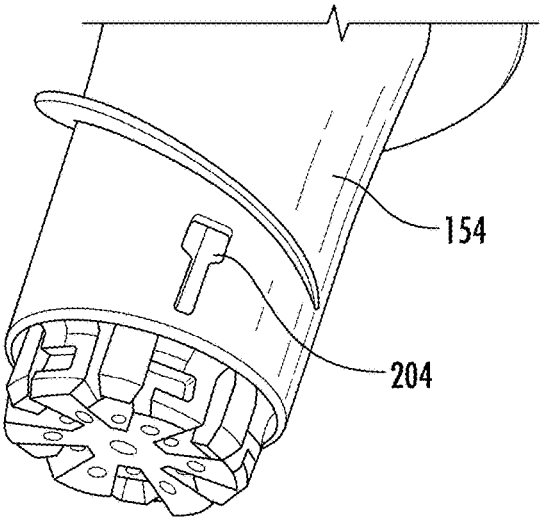
FIG. 15G illustrates a seventh portion of the sequence for the transitioning of the agitator between the stowed configuration (A) and the grabbing configuration (B)

As shown in FIG. 15C, the hook 202 is slid vertically upwards, moving the wedge 252 away from the handle standoff 254. As shown in FIG. 15D, the hook 202 is now completely detached from the handle portion 151 and can now be attached to the barrel 154. FIG. 15E shows the exposed cavity 206 of the handle portion 151 once the hook 202 is removed. FIG. 15F shows the detected hook 202 freed from the handle portion 151 and ready for attachment to the barrel 154. FIG. 15G shows the barrel 154 and attachment aperture 204 where the hook 202 is to be attached for use in the grabbing configuration (B).

Figure 15H:
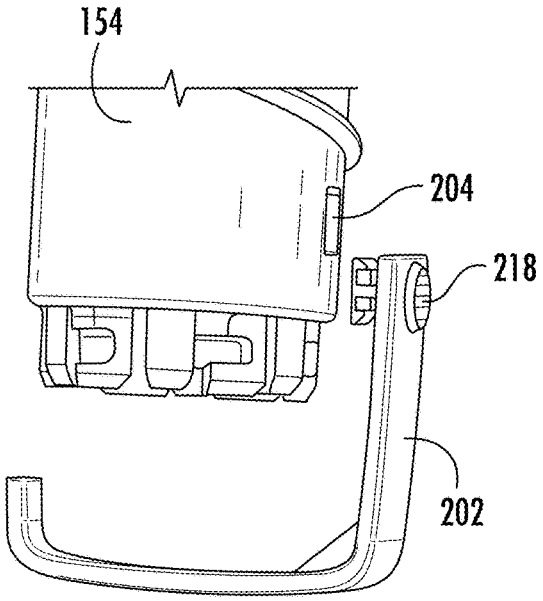
FIG. 15H illustrates a eighth portion of the sequence for the transitioning of the agitator between the stowed configuration (A) and the grabbing configuration (B)
Figure 15I:
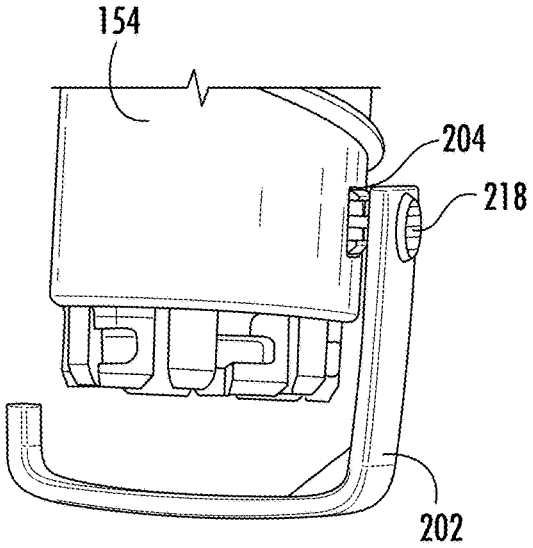
FIG. 15I illustrates a ninth portion of the sequence for the transitioning of the agitator between the stowed configuration (A) and the grabbing configuration (B)
Figure 15J:
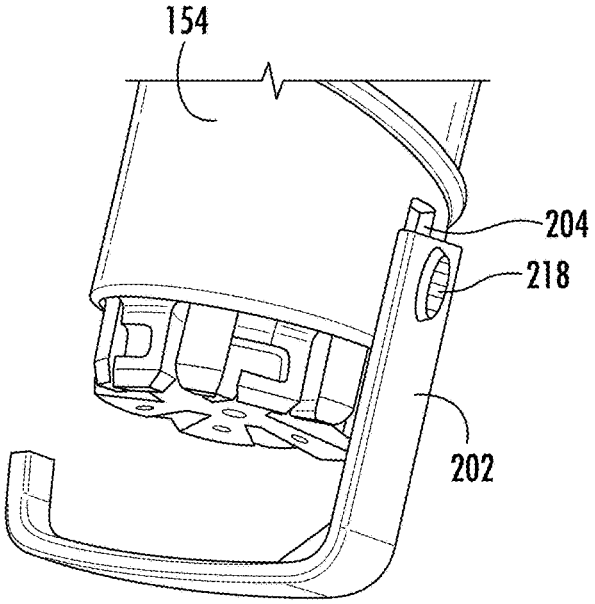
FIG. 15J illustrates a tenth portion of the sequence for the transitioning of the agitator between the stowed configuration (A) and the grabbing configuration (B).

As shown in FIG. 15H, the hook 202 is aligned with the attachment aperture 204 of the barrel 154. This allows for the slide 218 to be inserted into the attachment aperture 204. As shown in FIG. 15I, the fastener body 240 of the hook 202 is entering the attachment aperture 204 of the barrel 154. As shown in FIG. 15J, the hook 202 is moved downwards into the attachment aperture 204. This may accordingly cause the wedge 248 of the barrel attachment member 246 to catch the barrel standoff 244 inside the barrel 154. Once engaged, the hook 202 may be secured for use. For example, the hook 202 may be used to pick clothes from out of the laundry treating appliance 10 (or out of another laundry treating appliance 10, or for another purpose entirely).

Turning to the process for transitioning of the agitator 150 from the grabbing configuration (B) to the stowed configuration (A), at FIG. 15J, the hook 202 is located in the attachment aperture 204 of the barrel 154 in the grabbing configuration (B). The button 250 of the slide 218 is pressed to cause the fastener body 240 of the hook 202 to move inwards further into the attachment aperture 204 of the barrel 154. This may accordingly cause the wedge 248 of the barrel attachment member 246 to become freed from the barrel standoff 244 inside the barrel 154. Once disengaged, as shown in FIG. 15I the hook 202 may be slid upwards in the attachment aperture 204 and then out of the attachment aperture 204 as shown in FIG. 15H. The barrel 154 as shown in FIG. 15G may now be free of the hook 202, which is now separate as shown in FIG. 15F. The hook 202 may then be inserted into the cavity 206 of the handle portion 151 for storage.

As shown in FIG. 15D, the hook 202 is aligned for insertion into the cavity 206. As shown in FIG. 15C, the fastener body 240 of the hook 202 is entering the attachment aperture 207 of the handle portion 151. As shown in FIG. 15B, the button 250 of the slide 218 is pressed, the hook 202 is moved downwards into the attachment aperture 207. Once moved, as shown in FIG. 15A the button 250 is released, which accordingly causes the wedge 252 of the handle attachment member 251 to catch the handle standoff 254 inside the handle portion 151. At this point, the hook 202 is secured into the cavity 206 for storage in the stowed configuration (A).

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, life cycle, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A removable clothes mover of a laundry treatment machine for retrieving laundry items, comprising:

a barrel having upper and lower ends;

a hook having a curved portion for grabbing and holding laundry items; and a handle portion attached to the upper end of the barrel, the handle portion defining a cavity sized for receiving the hook in an orientation where a free end of the hook points downward and a shank portion of the hook is aligned parallel to a side of the handle portion, wherein the hook is selectively positionable to each of:

a stowed configuration wherein the hook is nested into the cavity of the handle portion, or a grabbing configuration wherein the hook is extended relative to a lower end of the barrel for use in retrieving the laundry items.

2. The removable clothes mover of claim 1, wherein the cavity of the handle portion defines a recess that is complementary in shape to the hook, such that in the stowed configuration, the hook is substantially flush with the exterior surface of the handle portion.

3. The removable clothes mover of claim 1, wherein a first portion of the cavity is defined into a first side of the handle portion to receive the shank portion of the hook, and a second portion of the cavity is defined into the top and/or other side of the handle portion to receive a curved portion of the hook.

4. The removable clothes mover of claim 1, wherein, in the grabbing configuration, the hook is oriented such that the free end points upwards and the shank portion spaces the curved portion below the lower end of the barrel.

5. The removable clothes mover of claim 1, wherein the hook comprises a latch mechanism configured to selectively lock the hook into the handle portion in the stowed configuration and lock the hook into the barrel in the grabbing configuration.

6. The removable clothes mover of claim 5, wherein the barrel defines a barrel attachment aperture as a through hole into the interior of the barrel, the handle portion defines a handle attachment aperture as a through hole into the interior of the handle portion, and the latch mechanism comprises a slide movable laterally through the shank portion, the slide being sized to be insertable into each of the barrel attachment aperture and the handle attachment aperture.

7. The removable clothes mover of claim 6, wherein the barrel comprises a standoff located inside the barrel, the handle portion comprises a standoff located inside the handle portion, and the slide defines one or more attachment members extending transversely from the slide, the one or more attachment members each comprising a wedge having a flat face spaced apart from the slide and an angled face sloped toward the free end of the respective attachment member, wherein the flat face of the wedge is located to secure the hook in the grabbing configuration by engaging a respective standoff, and the angled face is configured to facilitate disengagement by urging the respective attachment member out of the aperture by riding the respective standoff.

8. The removable clothes mover of claim 7, wherein the slide comprises a button that, when pressed, causes the slide to move laterally inward into the attachment apertures to disengage the wedge of the one or more attachment members from one of the standoffs, allowing the hook to be removed from the grabbing configuration or the stowed configuration.

9. The removable clothes mover of claim 8, further comprising a spring to bias the button laterally outward with respect to the attachment apertures, such that the slide automatically returns to a locked position when the button is released.

10. The removable clothes mover of claim 1, wherein the exterior surface of the barrel comprises one or more radially extending vanes to impart mechanical action to laundry items during operation of the laundry treatment machine.

11. The removable clothes mover of claim 1, wherein the hook further comprises a rib extending from a throat side of the shank portion to the curved portion of the hook to provide additional rigidity to the hook.

12. A removable clothes mover of a laundry treatment machine for retrieving laundry items, comprising:

a barrel having upper and lower ends, the barrel defining a barrel attachment aperture towards the lower end;

a hook having a generally J-shaped structure for grabbing and holding laundry items; and a handle portion attached to the upper end of the barrel, the handle portion defining a cavity sized for receiving the hook in an orientation where a free end of the hook points downward and a shank portion of the hook is aligned parallel to a side of the handle portion, the cavity defining a handle attachment aperture;

a latch mechanism including a slide movable laterally through the shank portion of the hook, the slide being sized to be insertable into each of the barrel attachment aperture and the handle attachment aperture;

wherein the hook is selectively positionable in each of:

a stowed configuration wherein the hook is nested into the cavity of the handle portion and the slide engages into the handle attachment aperture, or a grabbing configuration for use in retrieving the laundry items wherein the hook is extended relative to a lower end of the barrel such that the slide engages into the handle barrel attachment aperture.

13. The removable clothes mover of claim 12, wherein the barrel comprises a standoff located inside the barrel, the handle portion comprises a standoff located inside the handle portion, and the slide defines one or more attachment members extending transversely from the slide, the one or more attachment members each comprising a wedge having a flat face spaced apart from the slide and an angled face sloped toward the free end of the respective attachment member, wherein the flat face of the wedge is located to secure the hook in the grabbing configuration by engaging a respective standoff, and the angled face is configured to facilitate disengagement by urging the respective attachment member out of the aperture by riding the respective standoff.

14. The removable clothes mover of claim 13, wherein the slide comprises:

a button that, when pressed, causes the slide to move laterally inward into the attachment apertures to disengage the wedge of the one or more attachment members from one of the standoffs, allowing the hook to be removed from the grabbing configuration or the stowed configuration; and a spring to bias the button laterally outward with respect to the attachment apertures, such that the slide automatically returns to a locked position when the button is released.

* * * * *